US007427124B2

(12) United States Patent
Kusakari

(10) Patent No.: US 7,427,124 B2
(45) Date of Patent: Sep. 23, 2008

(54) EJECTION HEAD, IMAGE FORMING APPARATUS, AND EJECTION CONTROL METHOD

(75) Inventor: Tsutomu Kusakari, Ashigara-Kami-Gun (JP)

(73) Assignee: FUJIFILM Corporation, Tokyo (JP)

( * ) Notice: Subject to any disclaimer, the term of this patent is extended or adjusted under 35 U.S.C. 154(b) by 490 days.

(21) Appl. No.: 11/092,586

(22) Filed: Mar. 29, 2005

(65) Prior Publication Data

US 2005/0219323 A1 Oct. 6, 2005

(30) Foreign Application Priority Data

Mar. 30, 2004 (JP) ..... 2004-100905

(51) Int. Cl.
*B41J 2/06* (2006.01)

(52) U.S. Cl. ..... 347/55; 347/22; 347/67; 347/68

(58) Field of Classification Search ..... 347/20, 347/22, 23, 28, 55, 68, 70, 71, 14, 17, 19
See application file for complete search history.

(56) References Cited

U.S. PATENT DOCUMENTS 5,835,113 A 11/1998 Hirahara et al. ..... 347/55
6,022,097 A 2/2000 Minemoto et al. ..... 347/55
6,220,695 B1 * 4/2001 Minemoto et al. ..... 347/55
6,533,397 B2 3/2003 Oishi ..... 347/55

FOREIGN PATENT DOCUMENTS

JP 8-142331 A 6/1996
JP 9-57974 A 3/1997
JP 2000-351222 A 12/2000
JP 2002-248766 A 9/2002
JP 2003-011354 A 1/2003

* cited by examiner

*Primary Examiner*—Juanita D Stephens
(74) *Attorney, Agent, or Firm*—Birch, Stewart, Kolasch & Birch, LLP

(57) ABSTRACT

The ejection head comprises: an ejection aperture which ejects onto a receiving medium a liquid in which charged dispersion particles are dispersed in a solvent; a pressure chamber which contains the liquid; an ejection channel which connects the ejection aperture with the pressure chamber; a pressurizing device which applies an ejection pressure to the liquid; and an electrode pair provided facing a vicinity of a meniscus of the liquid inside the ejection channel for generating an electric field inside the ejection channel, wherein at least a portion of the charged dispersion particles are caused to move to a vicinity of at least one of the electrodes in the electrode pair by means of the electric field generated inside the ejection channel, and the liquid from which the at least the portion of the charged dispersion particles have been removed is ejected from the ejection aperture by the pressurizing device.

23 Claims, 18 Drawing Sheets

EJECTION HEAD, IMAGE FORMING APPARATUS, AND EJECTION CONTROL METHOD

BACKGROUND OF THE INVENTION

1. Field of the Invention

The present invention relates to an ejection head, an image forming apparatus, and an ejection control method, and more particularly to the structure of an ejection head for ejecting droplets from an ejection nozzle, and to an ejection control technique.

2. Description of the Related Art

In recent years, inkjet printers have come to be used widely as data output apparatuses for outputting images, documents, or the like. An inkjet printer forms data on a printing matter (a recording medium) by driving recording elements (nozzles) of a recording head in accordance with data, thereby causing ink to be ejected from the nozzles.

In an inkjet printer, a print head having a plurality of nozzles is caused to move relative to the printed medium, and ink droplets are ejected from the nozzles, whereby the desired image is formed on the printed medium.

In an inkjet recording apparatus, when the ink inside the nozzles comes into contact with air, the ink solvent evaporates from the surface that is in contact with the air, and the viscosity of the ink increases. When ink is used whose viscosity is increased in this manner, nozzle obstruction occurs more easily, and failure to eject or ejection malfunction occurs.

At present, preliminary ejection (purging) is performed in order to prevent nozzle obstruction from occurring due to increased-viscosity ink, and applying suction to clogged nozzles and other recovery operations are performed.

In the inkjet recording apparatus described in Japanese Patent Application Publication No. 8-142331, a configuration is adopted whereby aggregation of color material is optimally controlled by an aggregation device which causes the color material components dispersed in the solvent to aggregate inside the head, and an ejection device which causes the color material components that have aggregated separately from the aggregation device to be ejected.

In the image forming apparatus described in Japanese Patent Application Publication No. 2002-248766, a configuration is adopted in an inkjet recording apparatus which ejects ink in which charged particles are dispersed in a solvent using a piezo ejection-type head, whereby a particle distribution control device is provided which controls the distribution of particles in the ejection head, and the solvent carrier only is ejected using the particle distribution control device after image recording is completed or when in a cleaning mode.

In the inkjet printer device described in Japanese Patent Application Publication No. 9-57974, a configuration is adopted whereby an electrophoretic migration electrode which causes the color material particles of a pigment-based ink to concentrate at the ejection nozzle by electrophoretic migration, an ejection electrode which ejects the ink, and an OFF-time measurement device which measures the OFF time in which the ink is not being ejected are provided, and the voltage applied to the electrophoretic migration electrode is controlled according to the OFF time thus measured.

However, when preliminary ejection for preventing nozzle obstruction is performed frequently, the amount of ink ejected during preliminary ejection increases, and ink is wasted. It also becomes impossible to print during the preliminary ejection operation, which can lead to decreased productivity.

An object of the inkjet recording apparatus described in Japanese Patent Application Publication No. 8-142331 is to control the aggregation of charged particles (color material particles) and enhance the precision of the deposited droplet concentration, and no disclosure is made therein concerning nozzle and meniscus surface maintenance for adapting to evaporation of the ink solvent.

In the configuration adopted in the image forming apparatus described in Japanese Patent Application Publication No. 2002-248766, ejection of the solvent carrier is limited to being performed when image recording is completed, or during execution of a cleaning mode, and no disclosure is made therein concerning preliminary ejection during printing, or of preliminary ejection in anticipation of ejection problems.

An object of the inkjet printer device described in Japanese Patent Application Publication No. 9-57974 is ink concentration control whereby the time in which ejection is not performed is measured, the aggregation of color material is controlled, and the color material is ejected in stable fashion, and disclosure of a preliminary ejection or other recovery operation is not made in this publication.

SUMMARY OF THE INVENTION

The present invention has been contrived in view of such circumstances, and an object thereof is to provide an ejection head, an image forming apparatus, and an ejection control method whereby preliminary ejection can be executed during printing, nozzle obstruction can be prevented, and productivity can be maintained.

In order to attain the aforementioned object, the present invention is directed to an ejection head, comprising: an ejection aperture which ejects onto a receiving medium a liquid in which charged dispersion particles are dispersed in a solvent; a pressure chamber which contains the liquid; an ejection channel which connects the ejection aperture with the pressure chamber; a pressurizing device which applies an ejection pressure to the liquid; and an electrode pair provided facing a vicinity of a meniscus of the liquid inside the ejection channel for generating an electric field inside the ejection channel, wherein at least a portion of the charged dispersion particles are caused to move to a vicinity of at least one of the electrodes in the electrode pair by means of the electric field generated inside the ejection channel, and the liquid from which the at least the portion of the charged dispersion particles have been removed is ejected from the ejection aperture by the pressurizing device.

According to the present invention, since a voltage is applied to the electrode pair provided inside the ejection channel facing the vicinity of the meniscus of the liquid in which the charged dispersion particles are dispersed, and the dispersion particles in the liquid are caused to move to the vicinity of at least one of the electrodes in the electrode pair by means of the electric field generated between the electrodes, the liquid on which the electric field acts and from which a portion or all of the charged dispersion particles in the liquid are removed can be ejected from the ejection aperture by the pressurizing device.

A liquid that is charged in advance may be used as the liquid (charged liquid) in which charged dispersion particles are dispersed in a solvent, a charging device may be provided inside the ejection head, and charging may be performed inside the ejection head.

The ejection channel signifies a channel from the ejection aperture to the pressure chamber, and a narrowed portion in which the channel diameter is narrowed, a tapered portion in which the channel diameter gradually changes, or the like provided to the leading end portion in the vicinity of the ejection aperture may also be included.

An aspect whereby a meniscus is formed in the vicinity of the ejection aperture may be included as part of an aspect whereby a meniscus is formed in the ejection channel.

The pressurizing device includes a system in which the pressure chamber is deformed using a piezoelectric element or other actuator and the liquid inside the pressure chamber is ejected, or a system in which a heat source or other bubble generating device is provided which generates a bubble in the liquid inside the pressure chamber, and the liquid inside the pressure chamber is ejected by the pressure of the bubble generated inside the pressure chamber.

The electrode pair may be disposed outside the ejection channel, or may be disposed so as to be in contact with the liquid inside the ejection channel.

The dispersion particles in the liquid in which charged dispersion particles are dispersed receive the force of the electric field generated between the electrodes, and are confined by electrostatic force in the vicinity of the electrode in the electric field. The dispersion particles may or may not come in contact with the electrode.

The ejection head includes a full-line-type ejection head in which ejection apertures for ejecting liquid droplets are arranged along a length corresponding to the entire width of the receiving medium; a serial-type ejection head (shuttle scan-type ejection head) which ejects liquid droplets onto the receiving medium while causing a short head in which ejection apertures for ejecting liquid droplets are arranged along a length shorter than the length corresponding to the entire width of the receiving medium to scan in the width direction of the receiving medium; and the like.

A configuration may be adopted in the full-line-type ejection head whereby short heads having a short row of ejection apertures that is less than the length corresponding to the entire width of the receiving medium are arranged in zigzag fashion and connected together to a length that corresponds to the entire width of the receiving medium.

In order to attain the aforementioned object, the present invention is also directed to an ejection head, comprising: an ejection aperture which ejects onto a receiving medium a liquid in which charged dispersion particles are dispersed in a solvent; a pressure chamber which contains the liquid; an ejection channel which connects the ejection aperture with the pressure chamber; a pressurizing device which applies an ejection pressure to the liquid; and an electrode pair including a first electrode and a second electrode, the first electrode being provided in a vicinity of a meniscus of the liquid inside the ejection channel, the second electrode being provided one of in the ejection channel upstream in the liquid channel from the first electrode and in the pressure chamber, the electrode pair generating an electric field in at least one of an area inside of the ejection channel and an area from the ejection channel to the inside of the pressure chamber, wherein at least a portion of the charged dispersion particles are caused to move to a vicinity of at least one of the electrodes in the electrode pair by means of the electric field generated inside the ejection channel, and the liquid from which the at least the portion of the charged dispersion particles have been removed is ejected from the ejection aperture by the pressurizing device.

According to the present invention, since a voltage is applied to the electrode pair provided in the vicinity of the meniscus of the liquid in which the charged dispersion particles are dispersed and further upstream inside the ejection channel, and the dispersion particles in the liquid in which the charged dispersion particles are dispersed are caused to move to the vicinity of at least one of the electrodes in the electrode pair by means of the electric field generated between the electrodes, the liquid on which the electric field acts and from which a portion or all of the charged dispersion particles in the liquid are removed can be ejected from the ejection aperture by the pressurizing device.

The above-described ejection head may include an inkjet head mounted in an inkjet recording apparatus which ejects ink onto a medium and forms an image.

Preferably, a voltage is applied between the electrode pair to generate the electric field so as to move the charged dispersion particles to the vicinity of the second electrode. According to this, since the dispersion particles in the liquid having charged dispersion particles dispersed therein and disposed in the vicinity of the meniscus can be caused to move to the vicinity of the electrode that is upstream in the liquid flow from the vicinity of the meniscus, a portion or all of the dispersion particles can be removed from the liquid having charged dispersion particles dispersed therein in the vicinity of the meniscus.

Preferably, a polarity of a voltage applied to the electrode pair is reversed to thereby reverse a direction of the electric field generated inside the ejection channel. According to this, by reversing the direction of the electric field inside the ejection channel, dispersion of the dispersion particles can be accelerated when the dispersion particles that have moved to the vicinity of the electrode pair are dispersed into the liquid.

An alternating current voltage may be used in the applied voltage instead of reversing the voltage applied to the electrode pair. A high-frequency alternating current voltage may be used for the alternating current voltage.

Preferably, during a preliminary ejection for ejecting the liquid inside the ejection channel, a voltage is applied to the electrode pair to move the charged dispersion particles to the vicinity of at least one of the electrodes in the electrode pair, and the liquid from which the at least the portion of the charged dispersion particles have been removed is ejected from the ejection aperture. According to this, in the preliminary ejection whereby the liquid inside the ejection channel is ejected, since the medium is caused to remain inside the ejection channel, and the liquid from which a portion or all of the dispersion particles are removed is ejected, the quantity of dispersion particles ejected during preliminary ejection can be reduced.

Preliminary ejection may include ejection which ejects the liquid inside the ejection channel in order to prevent ejection malfunction due to an increase in the viscosity of the liquid in the vicinity of the ejection aperture, ejection which ejects impurities in the vicinity of the ejection aperture and inside the ejection channel, ejection in the initialization operation performed during actuation of the ejection head, and the like. Preliminary ejection may also include operations referred to as purge, liquid ejection, dummy ejection, and the like.

In order to attain the aforementioned object, the present invention is also directed to an image forming apparatus which forms an image on an image formation medium using a liquid in which charged dispersion particles are dispersed in a solvent, the apparatus comprising: an ejection head including: an ejection aperture which ejects the liquid onto the image formation medium; a pressure chamber which contains the liquid; an ejection channel which connects the ejection aperture with the pressure chamber; a pressurizing device which applies an ejection pressure to the liquid; and an electrode pair provided facing a vicinity of a meniscus of the liquid inside the ejection channel for generating an electric field inside the ejection channel; a voltage control device which controls a voltage applied to the electrode pair so that the charged dispersion particles are caused to move to a vicinity of at least one of the electrodes in the electrode pair and at least a portion of the charged dispersion particles are removed from the liquid; and an ejection control device which performs control so that the liquid from which the at least the portion of the charged dispersion particles have been removed is ejected from the ejection aperture using the pressurizing device.

The applied voltage control performed by the voltage control device may include ON/OFF control of the voltage applied to the electrode pair, polarity control, voltage value control, and the like.

The image formation medium may include a medium referred to as recording media, a recorded medium, an image formation medium, or the like. The image formation medium may also include the above-described receiving medium.

In order to attain the aforementioned object, the present invention is also directed to an image forming apparatus which forms an image according to image data on an image formation medium using a liquid in which charged dispersion particles are dispersed in a solvent, the apparatus comprising: an ejection head including: an ejection aperture which ejects the liquid onto the image formation medium; a pressure chamber which contains the liquid; an ejection channel which connects the ejection aperture with the pressure chamber; a pressurizing device which applies an ejection pressure to the liquid; and an electrode pair including a first electrode and a second electrode, the first electrode being provided in a vicinity of a meniscus of the liquid inside the ejection channel, the second electrode being provided one of in the ejection channel upstream in the liquid channel from the first electrode and in the pressure chamber, the electrode pair generating an electric field in at least one of an area inside of the ejection channel and an area from the ejection channel to the inside of the pressure chamber; a voltage control device which controls a voltage applied to the electrode pair so that the charged dispersion particles are caused to move to a vicinity of at least one of the electrodes in the electrode pair and at least a portion of the charged dispersion particles are removed from the liquid; and an ejection control device which performs control so that the liquid from which the at least the portion of the charged dispersion particles have been removed is ejected from the ejection aperture using the pressurizing device.

The liquid in which charged dispersion particles are dispersed in a solvent may include ink used by an image forming apparatus (inkjet recording apparatus) which ejects ink droplets onto a medium and forms an image, and the dispersion particles may include the ink color material particles dispersed in the ink. The ink can be rendered transparent when the solute in the ink is moved.

Preferably, the voltage control device controls the voltage applied to the electrode pair to generate the electric field so as to move the charged dispersion particles to the vicinity of the second electrode.

The voltage control device may include a voltage generating device which generates a voltage applied to the electrode pair, a control device which performs voltage ON/OFF control and polarity reversal control, a stabilizing device which stabilizes the generated voltage, and the like.

Preferably, the voltage control device reverses a polarity of the voltage applied to the electrode pair and thereby reverses a direction of the electric field generated inside the ejection channel.

Preferably, during a preliminary ejection for ejecting the liquid inside the ejection channel, the voltage control device applies the voltage to the electrode pair to cause the charged dispersion particles to move to the vicinity of at least one of the electrodes in the electrode pair, and the liquid from which the at least the portion of the charged dispersion particles have been removed is ejected from the ejection aperture by the pressurizing device.

Preferably, the image forming apparatus further comprises: a downtime computation device which computes a downtime of each of ejection apertures in the ejection head from the image data; and a selection device which selects at least one ejection aperture of which downtime computed by the downtime computation device is larger than a pre-set threshold value, wherein the ejection control device performs control such that the preliminary ejection is performed for the at least one ejection aperture selected by the selection device. According to this, the downtime for each ejection aperture is computed from the image data, the ejection apertures having downtimes that are longer than the prescribed time (more specifically, ejection apertures at risk for ejection malfunction) are selected, and preliminary ejection can be performed as needed.

A plurality of threshold values may be provided, and a threshold value may be selected according to temperature, time of continuous operation, and other operational parameters.

Preferably, the image forming apparatus further comprises: a concentration prediction device which predicts a concentration of the liquid to be ejected after the preliminary ejection, wherein the ejection control device performs control which changes an ejected quantity of the liquid ejected after the preliminary ejection according to the concentration predicted by the concentration prediction device. According to this, since the concentration of the liquid after preliminary ejection is predicted, and the amount of ejected liquid is changed based on the prediction results, the concentration of the liquid during ejection after preliminary ejection can be maintained.

A configuration may be adopted whereby the concentration data for the liquid can be recorded in a table for each parameter that includes environmental temperature, liquid type, and the like, and the liquid concentration data for the corresponding parameter is retrieved. A determination device which directly or indirectly determines the concentration of the liquid may also be provided.

Preferably, the voltage control device performs control so as to reverse a polarity of the voltage applied to the electrode pair a plurality of times after the preliminary ejection. According to this, the diffusion of dispersion particles in the liquid after preliminary ejection can be accelerated, and the time required until the liquid concentration is recovered after preliminary ejection can be shortened.

Preferably, during the preliminary ejection from the at least one ejection aperture selected by the selection device, the liquid from which the at least the portion of the charged dispersion particles have been removed is ejected onto the image formation medium during image formation. According to this, since preliminary ejection can be performed during image formation, enhanced productivity can be anticipated. According to this, since the liquid rendered transparent by the removal of a portion or all of the ink color material particles can be ejected onto the image formation medium in an inkjet recording apparatus, preliminary ejection can be performed even when another ejection aperture has been activated for image formation.

In order to attain the aforementioned object, the present invention is also directed to an ejection control method for an ejection apparatus provided with an ejection head including an ejection aperture which ejects onto a receiving medium a liquid in which charged dispersion particles are dispersed in a solvent, the method comprising the steps of: applying a voltage between an electrode pair disposed facing a vicinity of a meniscus of the liquid inside an ejection channel which connects the ejection aperture with a pressure chamber which contains the liquid so as to generate an electric field inside the ejection channel; controlling the voltage applied to the electrode pair so as to cause the charged dispersion particles to move to a vicinity of at least one of the electrodes in the electrode pair, and thereby removing at least a portion of the charged dispersion particles from at least a portion of the liquid inside the ejection channel; and ejecting from the ejection aperture the liquid from which the at least the portion of the charged dispersion particles have been removed.

According to the present invention, in an ejection head which ejects liquid in which charged dispersion particles are dispersed in a solvent, an electrode pair is provided to face the vicinity of the meniscus formed in the vicinity of the ejection aperture, an electric field is generated between the electrodes, the charged dispersion particles are moved to the vicinity of the electrode pair, and the liquid from which a portion or all of the dispersion particles are removed from the liquid in the vicinity of the meniscus is ejected, so that solute (the dispersion particles) waste can be eliminated.

When one of the electrodes in the electrode pair is provided in the vicinity of the meniscus, and the other electrode is provided further upstream in the liquid channel from the first electrode, the dispersion particles can be moved upstream in the liquid channel.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
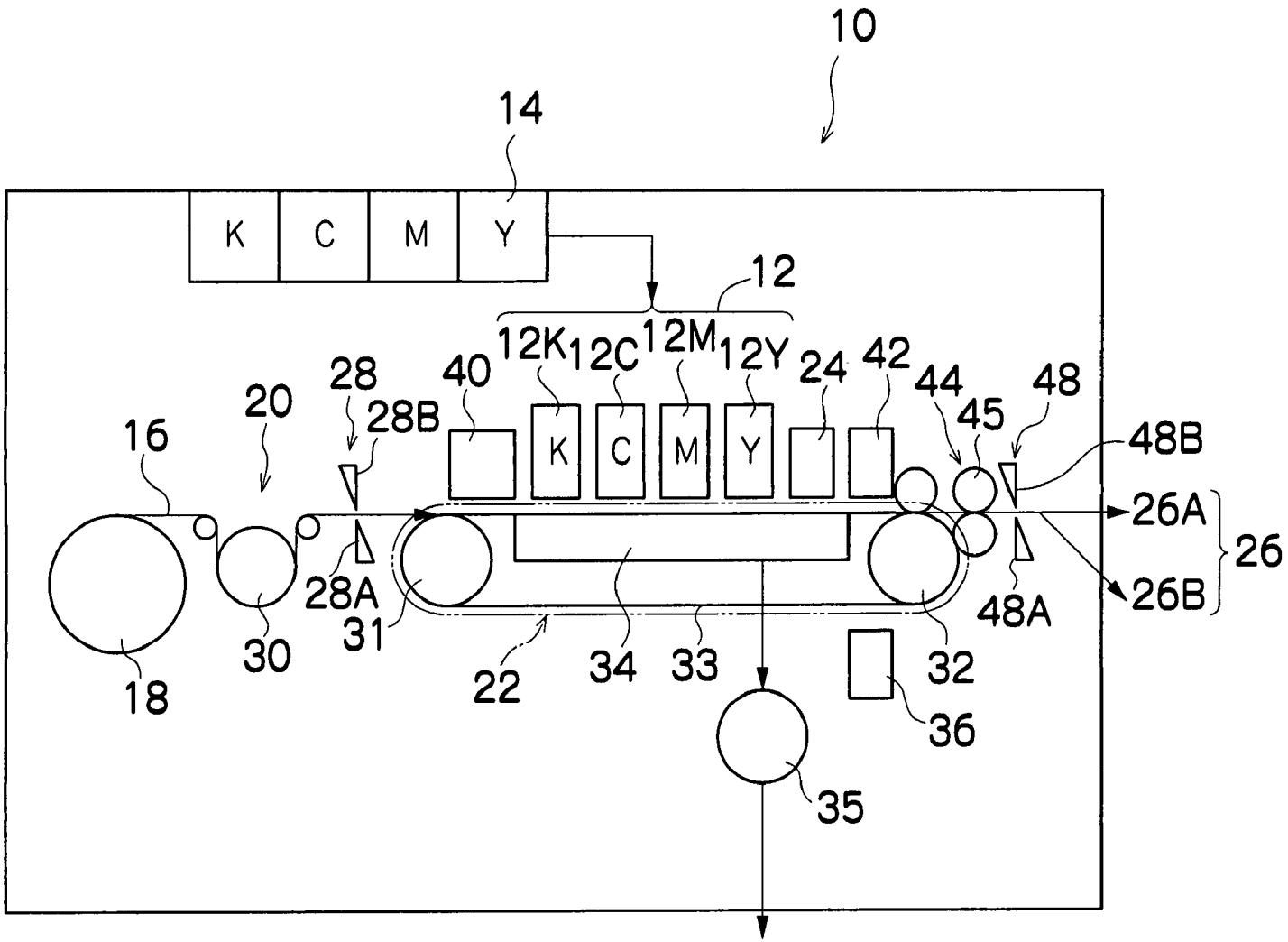
FIG. 1 is a general schematic drawing of an inkjet recording apparatus including a print head according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In the inkjet recording apparatus 10, ink is used in which ink color material particles stained with pigment and dye are dispersed in a non-electrolyte (non-charged) ink solvent. In this arrangement, a charged ink is used in which the ink color material is charged in advance, but non-charged ink color material particles may be charged using a charging device by the time the particles reach the ejection area of the print heads 12K, 12C, 12M, and 12Y.

In the charging device, an embodiment may be used whereby charging is performed by irradiation with light using ink color material particles that are charged by irradiation with light.

The ink solvent utilized in the present invention preferably has a specific electrical resistance of $10^4$ Ωcm to $10^{15}$ Ωcm and a relative dielectric constant of 2.0 to 80. The viscosity of the solvent is preferably 1.0 cP to 20 cP, and the surface tension thereof is preferably 19 to 74 Nm/m.

Pigments that are in common use in conventional ink compositions or in the field of printing (in which color material particles disperse in the solvent without being dissolved) can be used as the color material. Dispersed resin particles for enhancing the permanence of the image after printing may also be included with the colorant particles.

The mean diameter of the ink color material particles, resin particles, and other particles dispersed in the ink solvent applied in the present invention is preferably 0.05 μm to 5 μm. A mean diameter of 0.1 μm to 1.5 μm is more preferred, and a range of 0.1 μm to 1.0 μm is ideal.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
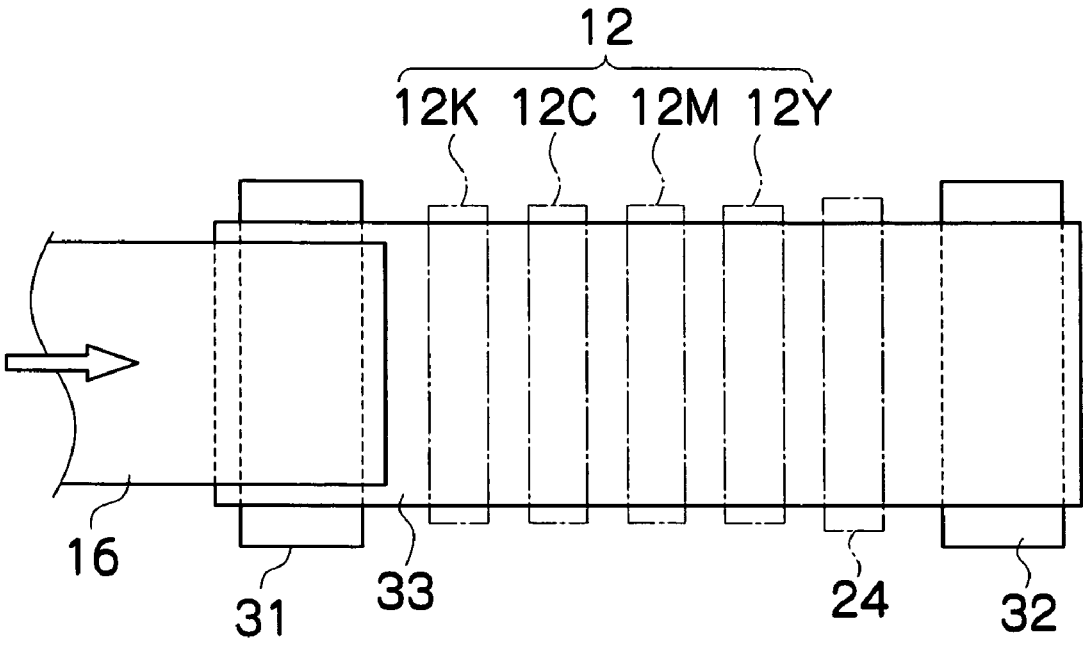
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The details of the ejection determination are described later.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
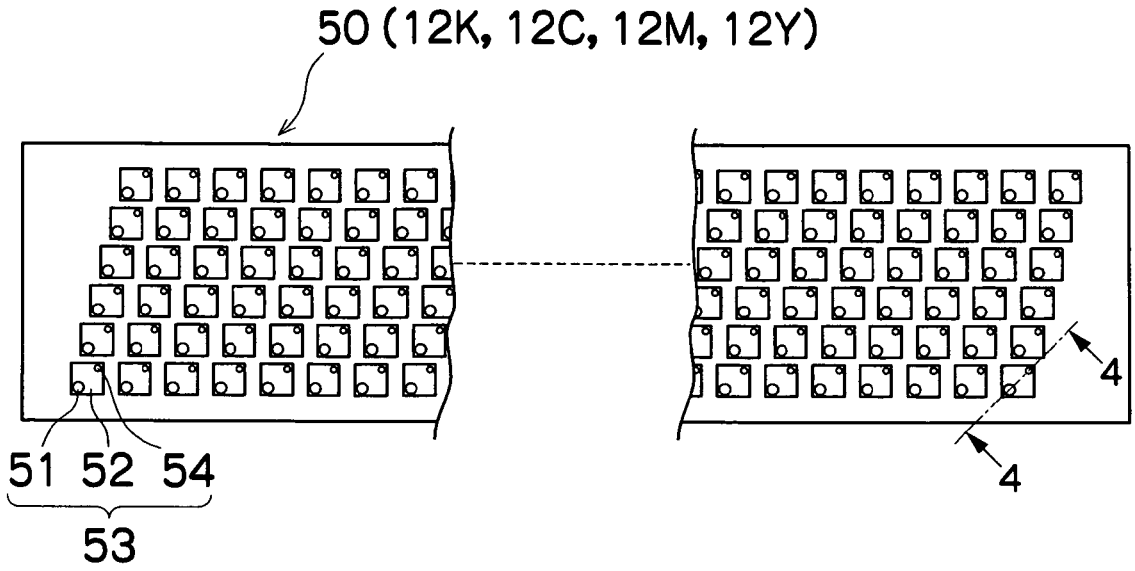
FIG. 3A is a perspective plan view showing an example of a configuration of a print head.
Figure 3B:
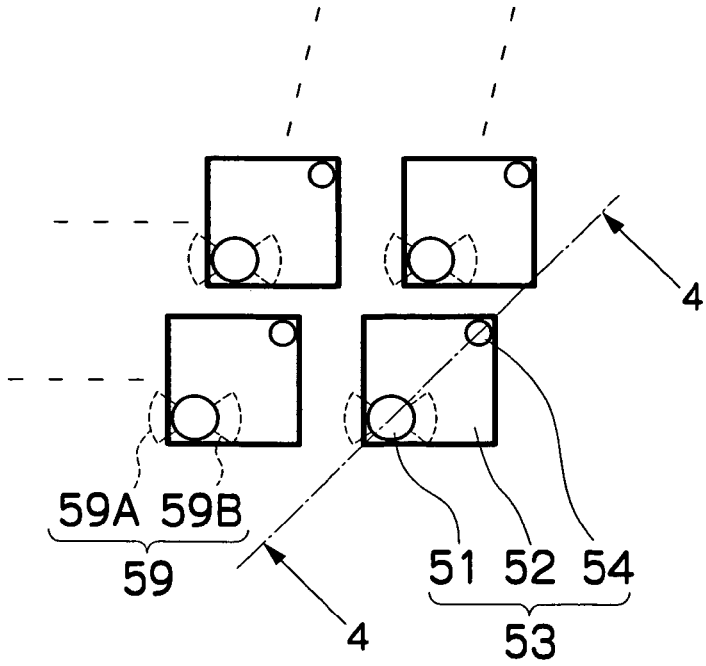
FIG. 3B is a partial enlarged view of FIG. 3A.
Figure 3C:
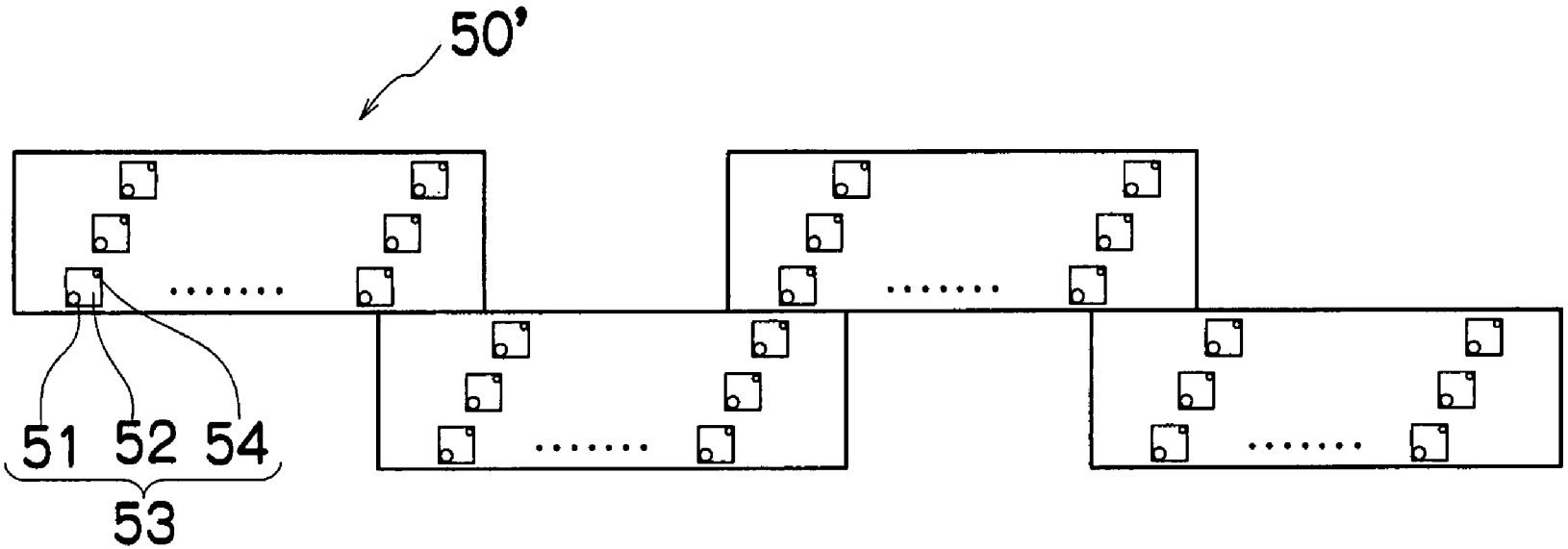
FIG. 3C is a perspective plan view showing another example of the configuration of the print head.
Figure 4:
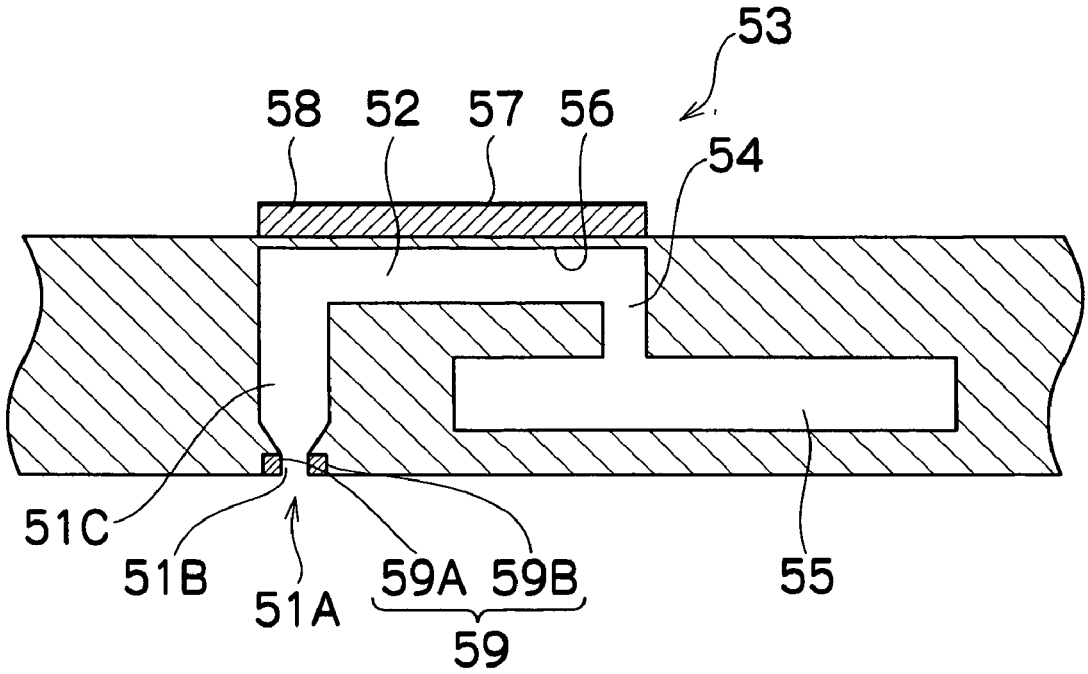
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink ejection nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Every nozzle in the print head 50 is provided with an electrophoretic electrode 59. The electrophoretic electrode 59 is formed by a pair of electrodes made up of an electrode 59A and an electrode 59B.

The electrophoretic electrode 59 of the present example is provided to the nozzle end portion 51B in the vicinity of the nozzle opening portion 51A, and is provided in opposing fashion in the direction of the external periphery of the nozzle end portion 51B so as to sandwich the nozzle channel (the ink flowing inside the nozzle channel). One or both of the electrodes 59A and 59B for which a prescribed liquid-repellant treatment is performed may be provided to the inside of the nozzle end portion 51B (so as to be in contact with the ink inside the channel).

The term "nozzle" in the present example refers to a portion or all of the ejection channel 51C from the nozzle opening portion 51A to the pressure chamber 52. The nozzle opening portion 51A or the nozzle end portion 51B is sometimes referred to simply as the "nozzle."

The ejection channel 51C may be formed in a tapered shape whereby the channel diameter continuously changes towards the nozzle end portion 51B as shown in FIG. 4, and the cross-sectional shape of the connecting portion in which the ejection channel 51C is directly connected to the nozzle end portion 51B may be stepped.

Figure 5:
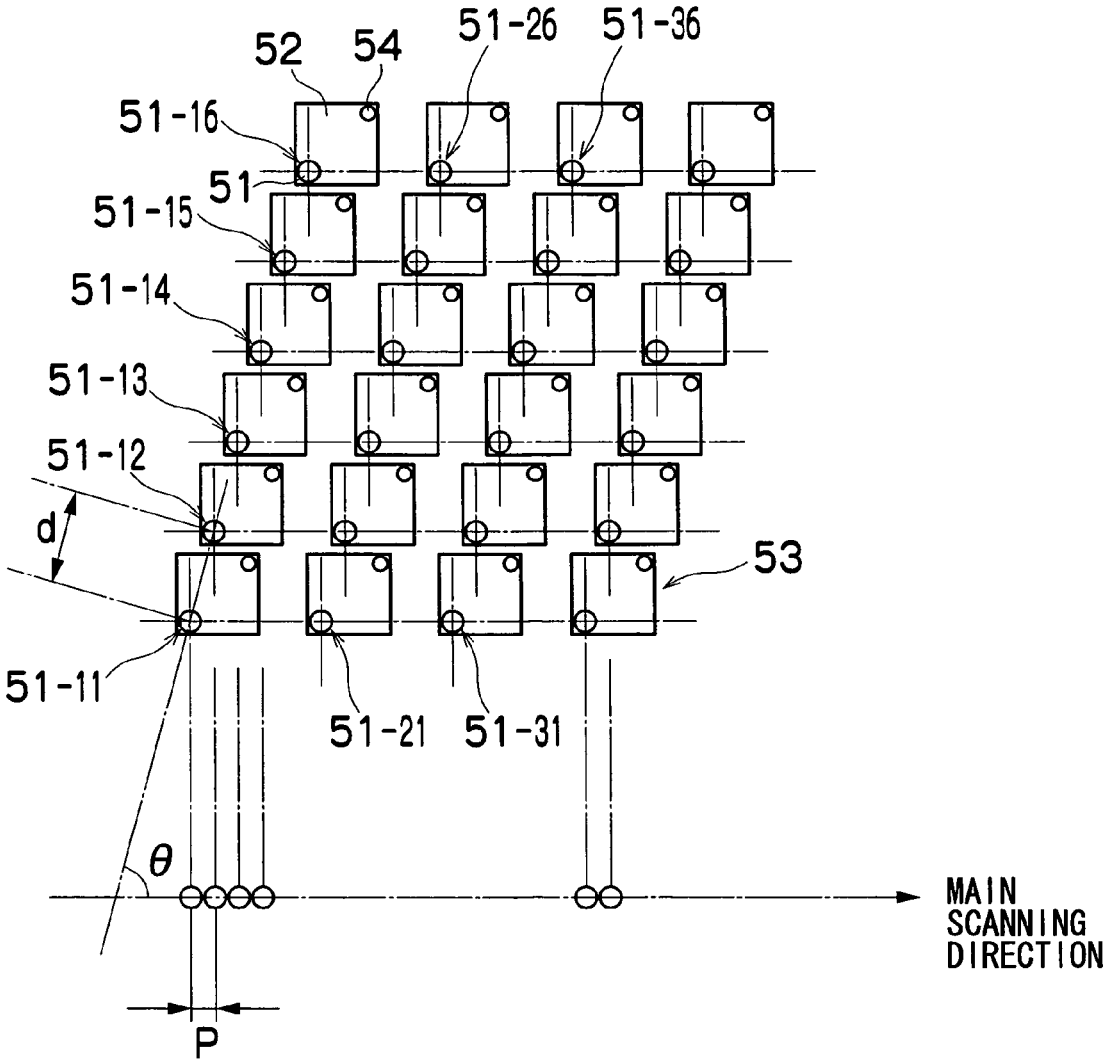
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle 0 with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for ejecting ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 6:
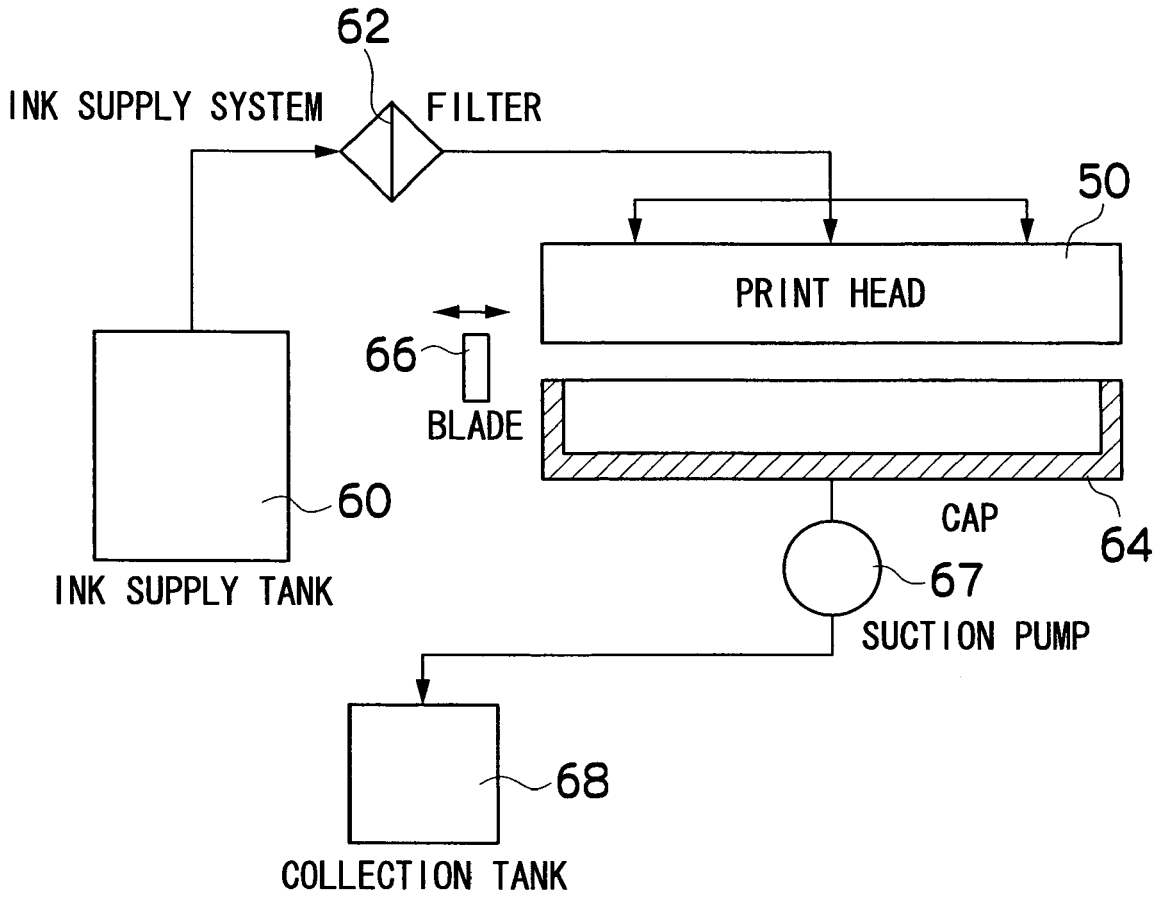
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 is operated. Before reaching such a state the actuator 58 is operated (in a viscosity range that allows ejection by the operation of the actuator 58), and the preliminary ejection is made toward the ink receptor to which the ink whose viscosity has increased in the vicinity of the nozzle is to be ejected. After the nozzle surface is cleaned by a wiper such as the cleaning blade 66 provided as the cleaning device for the nozzle face, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on. In addition, a description of the preliminary ejection according to the inkjet recording apparatus 10 is described later.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 52, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

Figure 7:
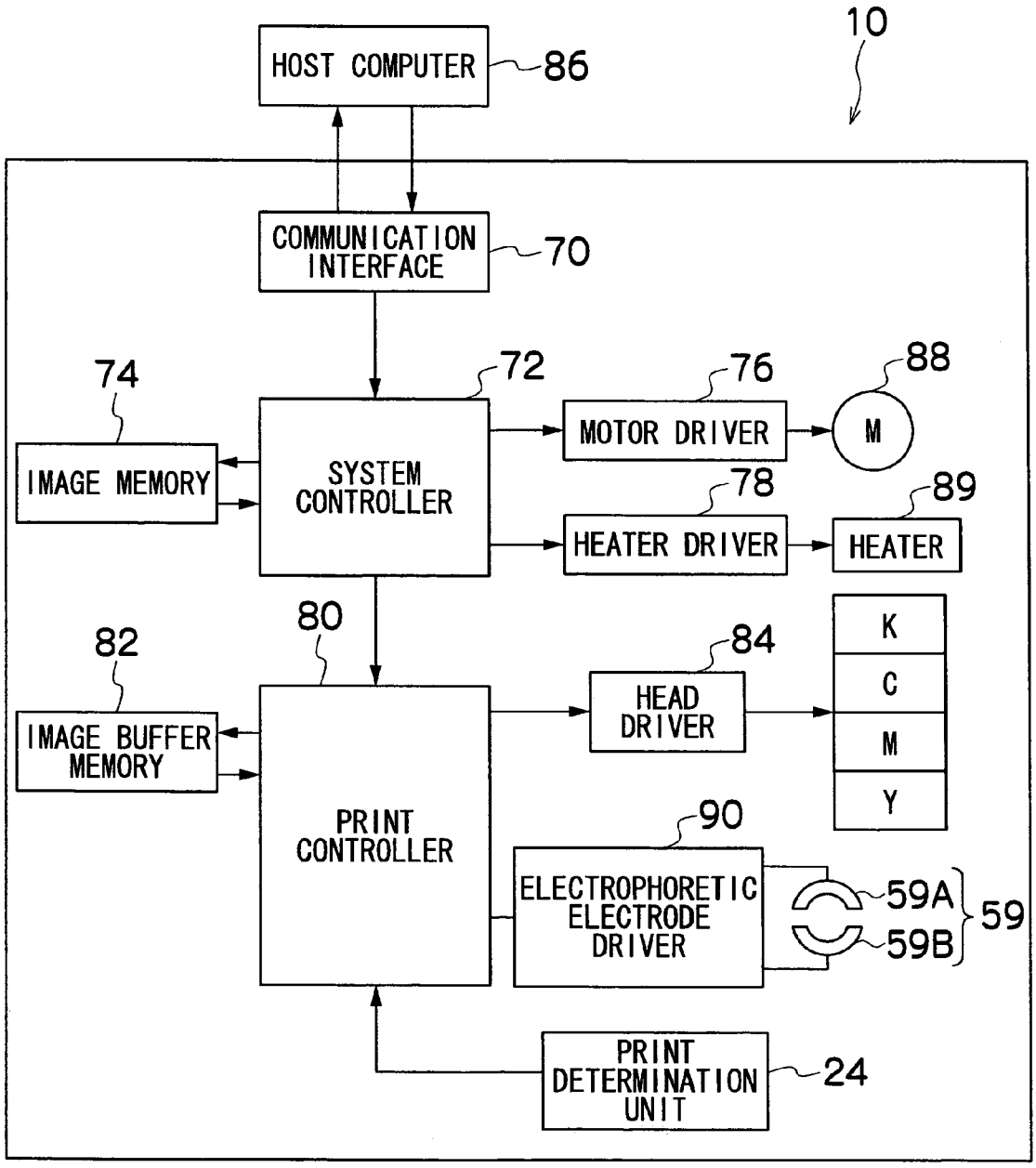
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver (a ejection control device) 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the ejection amount and the ejection timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 for the print heads 12K, 12C, 12M and 1 2Y of the respective colors on the basis of the print data received from the print controller 80. A feedback control system for keeping the drive conditions for the print heads constant may be included in the head driver 84.

Various control programs are stored in the program storage unit not shown in the diagram, and the control programs are read and executed in accordance with commands from the system controller 72. The program storage unit may use ROM, EEPROM, or other semiconductor memory, and may use a magnetic disk or the like. An external interface may be provided, and a memory card or PC card may be used. A plurality of recording media may, of course, be provided from among these recording media.

The program storage unit may also be used together with operational parameters and other recording devices (not shown).

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The read start timing for the line sensor is determined from the distance between the line sensor and the nozzles and the conveyance velocity of the recording paper 16.

The print controller 80 makes various compensation with respect to the print head 50 as required on the basis of the information obtained from the print determination unit 24.

In the example shown in FIG. 1, a configuration is adopted whereby the print determination unit 24 is provided on the print surface side, the print surface is illuminated by a cold cathode tube or other light source (not shown) disposed in the vicinity of the line sensor, and the reflected light thereof is detected by the line sensor, but another configuration may be adopted in an implementation of the present invention.

The print controller 80 also presents an instruction signal to the electrophoretic electrode driver (voltage control device) 90 which applies a voltage to the electrophoretic electrode 59. The electrophoretic electrode driver 90 performs ON/OFF control and polarity reversal (switching) control of the voltage applied to the electrophoretic electrode 59 in accordance with the instruction signal sent from the print controller 80.

Preliminary Ejection Control

The preliminary ejection control of the present inkjet recording apparatus 10 will next be described in detail using FIGS. 8 through 10 and FIGS. 17A and 17B. In the preliminary ejection of the inkjet recording apparatus 10, the ink color material particles 100 are caused to move to the vicinity of the electrophoretic electrode 59 and are retained in the nozzles 51 using the electrophoretic electrode 59 provided to each nozzle, and the ink solvent 120 only, or the ink solvent (ink) 120 in which the concentration of the ink color material particles 100 is reduced is ejected from the nozzles 51. The "ink solvent" is sometimes referred to simply as the "ink."

Figure 8:
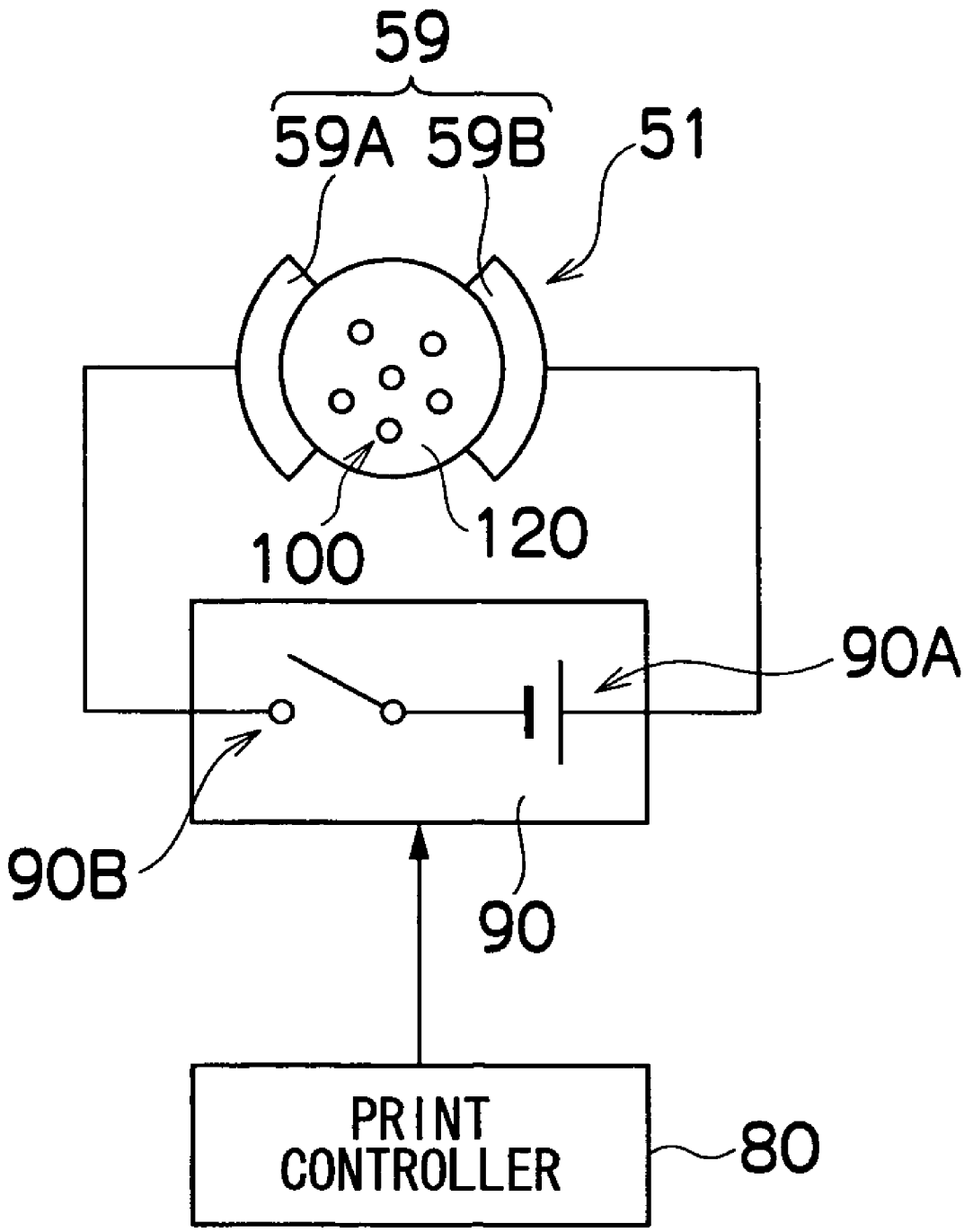
FIG. 8 is a block diagram showing the configuration of the electrophoretic device.

FIG. 8 is a block diagram showing the configuration of the electrophoretic device in which the electrophoretic electrode 59 is used. FIG. 8 depicts a state in which the charged ink color material particles 100 during the OFF-time of the electrophoretic electrode 59 are diffused in the ink solvent 120.

A meniscus surface is formed in the nozzle 51 (the nozzle end portion 51 B) by the ink solvent 120 that contains the charged ink color material particles 100, and when a voltage is not applied to the electrophoretic electrode 59, the ink color material particles 100 are dispersed in the ink solvent 120.

As shown in FIG. 8, the structure of the electrophoretic electrode driver 90 includes a voltage generator 90A (indicated by the cell symbol mark in FIG. 8) which generates the voltage supplied to the electrophoretic electrode 59, and a voltage controller 90B (indicated by the switch symbol mark in FIG. 8) which performs ON/OFF control of the voltage supply and reversal control of the voltage polarity. Besides these components, an input unit for the control signal sent from the print controller 80; a voltage output unit directly or indirectly connected to the electrophoretic electrode 59; a nozzle filter; a protection circuit for overvoltage, surging, and the like; and the like may also be included therein.

Figure 9A:
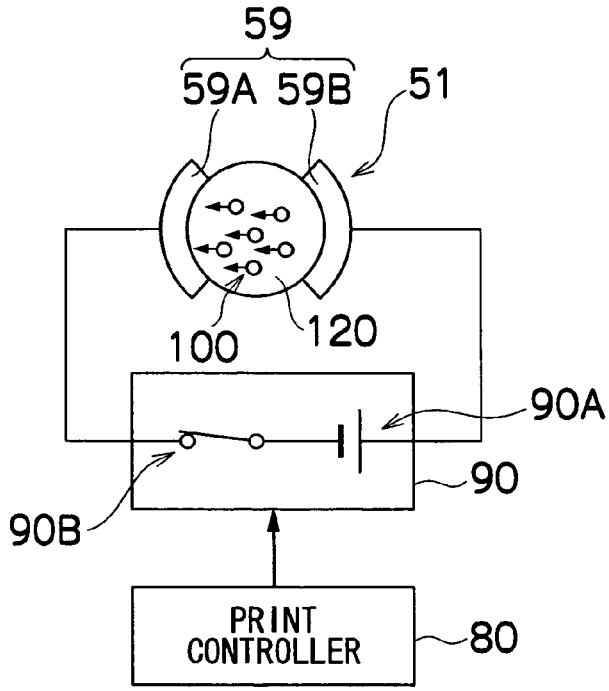
FIGS. 9A and 9B are diagrams depicting electrophoresis by the electrophoretic device shown in FIG. 8.

As shown in FIG. 9A, an electric field is generated between the electrode 59A and the electrode 59B when a voltage is applied to the electrophoretic electrode 59 from the electrophoretic electrode driver 90 in accordance with the control signal of the system controller 72. In FIG. 9A, the electrode 59A is the minus electrode, the electrode 59B is the plus electrode, and the electric field is generated in the direction from the electrode 59B to the electrode 59A (from right to left).

Figure 9B:
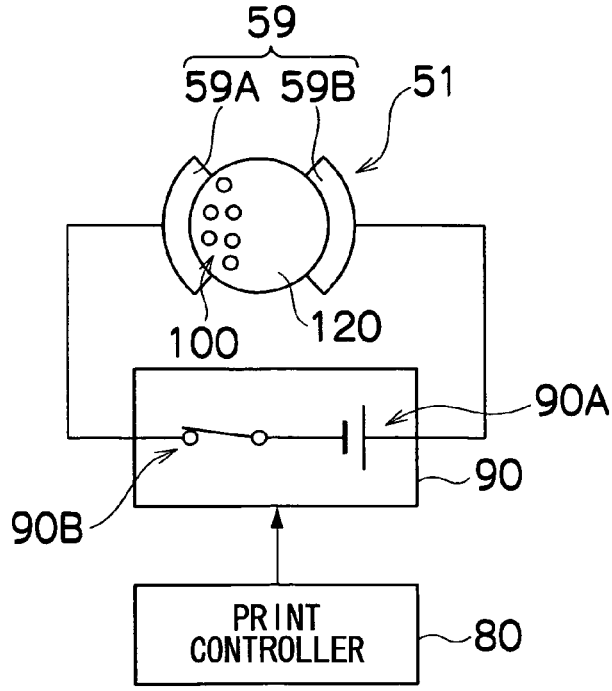

As shown in FIG. 9B, when the ink 120 passes through this electric field, the ink color material particles 100 move to the vicinity of the electrode 59A on the minus side if they are charged in the plus polarity, and are retained in the vicinity of the electrode 59A. Of course, control may also be performed whereby ink color material particles 100 that are charged in the minus polarity are moved to the vicinity of the electrode 59B on the plus side.

More specifically, it is sufficient if the ink color material particles 100 are concentrated (aggregated) and retained in the vicinity of the inner wall of the nozzle end portion 51B; and the ink color material particles 100 may be moved to the vicinity of the electrode 59A or to the vicinity of the electrode 59B.

When the ink color material particles 100 are retained in the vicinity of the electrophoretic electrode 59 (any one of the electrodes that include the electrode 59A and the electrode 59B) in this manner, the ink color material distribution of the ink inside the nozzle 51 changes, and the ink 120 inside the nozzle 51 is rendered transparent.

Figure 17A:
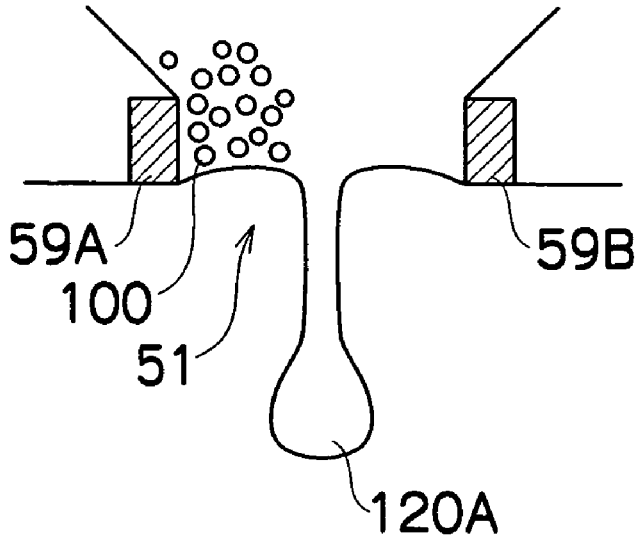
FIGS. 17A and 17B are schematic drawings showing the state of ink during preliminary ejection and during normal ejection.

In this state, when the actuator 58 shown in FIG. 4 is operated, the ink solvent or ink in a state of low coloration in which the concentration of ink color material particles 100 is reduced (specifically, the cleared ink 120A) is ejected from the nozzle 51 as shown in FIG. 17A, and the ink color material particles 100 that have moved to the vicinity of the electrophoretic electrode 59 remain inside the nozzle.

Figure 10A:
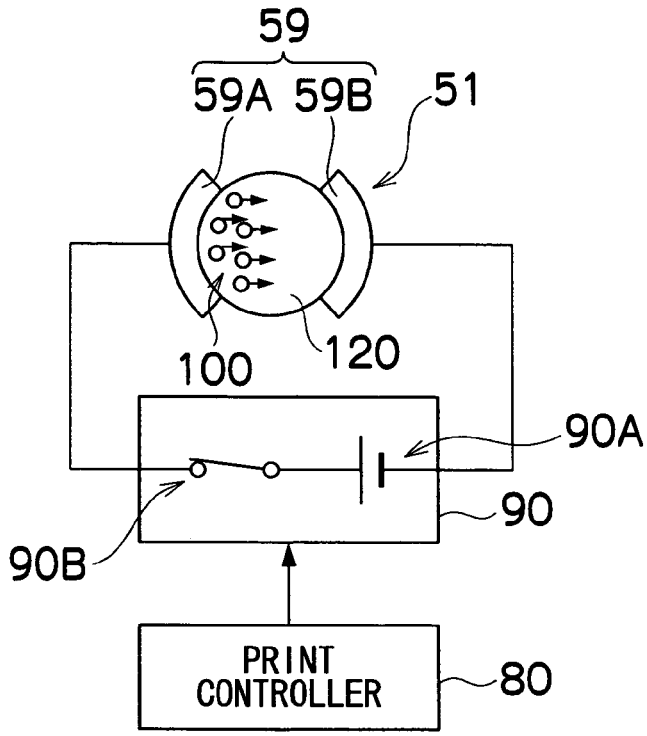
FIGS. 10A and 10B are diagrams depicting the electrophoresis shown in FIGS. 9A and 9B, and electrophoresis during reverse voltage application.
Figure 17B:
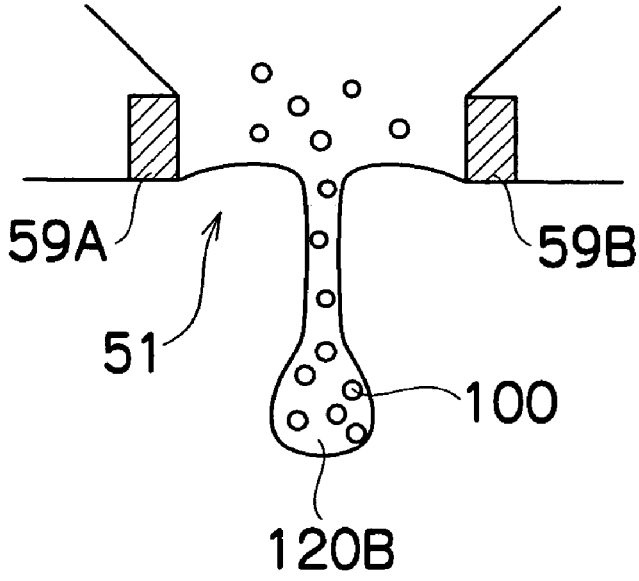

As shown in FIG. 10A, when preliminary ejection is completed, the polarity of the voltage applied to the electrophoretic electrode 59 from the electrophoretic electrode driver 90 is reversed, and the recovery operation by application of a reversed voltage for recovery is performed, which accelerates dispersion of the ink color material particles 100 into the ink solvent 120. FIG. 17B shows normal ejection (imaging ejection) whereby ink 120B in which the ink color material particles 100 are dispersed in the ink solvent 120 is ejected.

In the recovery operation, the electrode 59A becomes the plus electrode, the electrode 59B becomes the minus electrode, and an electric field oriented in the direction from the electrode 59A to the electrode 59B (from left to right) is generated. An electric field is generated in this case that is oriented in the opposite direction from the electric field by which the ink color material particles 100 are concentrated in the vicinity of the electrophoretic electrode 59 during preliminary ejection.

Figure 10B:
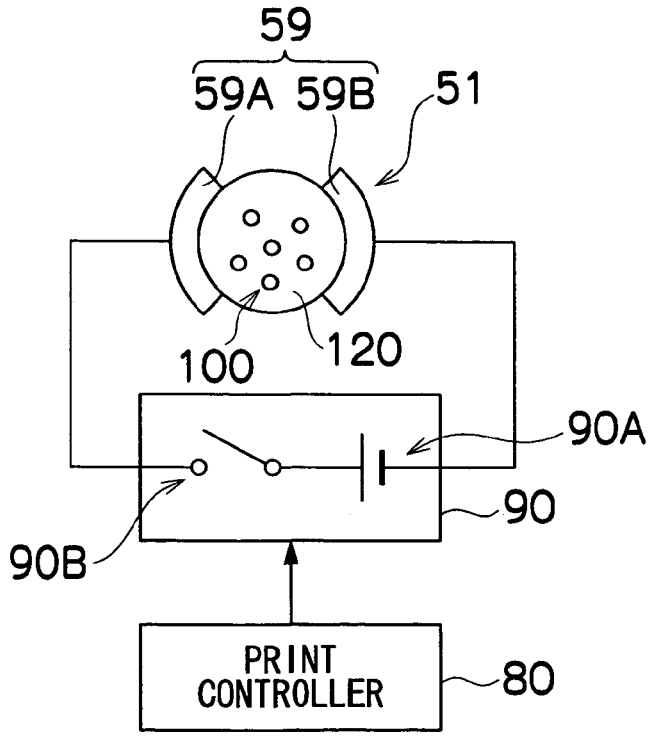

After the polarity of the voltage applied to the electrophoretic electrode 59 is reversed in this manner, since the ink color material particles 100 disperse to a certain degree after a prescribed time elapses, control is performed which turns off the voltage applied to the electrophoretic electrode 59, as shown in FIG. 10B.

In the present embodiment, an example has been described in which the electrophoretic electrode is provided in one pair, but the electrophoretic electrode 59 may be provided in two or more pairs. The electrode 59A and electrode 59B may also have the same shape and size, or may have different shapes and sizes. Furthermore, one electrode may be provided for a plurality of the other electrode.

After the charged ink color material particles 100 have been moved to the vicinity of the electrophoretic electrode 59 by electrophoretic migration, even if the voltage applied to the electrophoretic electrode 59 is turned off, the ink color material particles 100 gradually disperse into the ink solvent 120 after briefly remaining in the vicinity of the electrophoretic electrode. Therefore, after a voltage is applied to the electrophoretic electrode 59, if control is performed whereby the voltage is turned off after a prescribed period of time has elapsed, the power consumed for electrophoretic migration can be saved.

The modified example of the electrophoretic electrode 59 shown in FIG. 4 will next be described.

Figure 11:
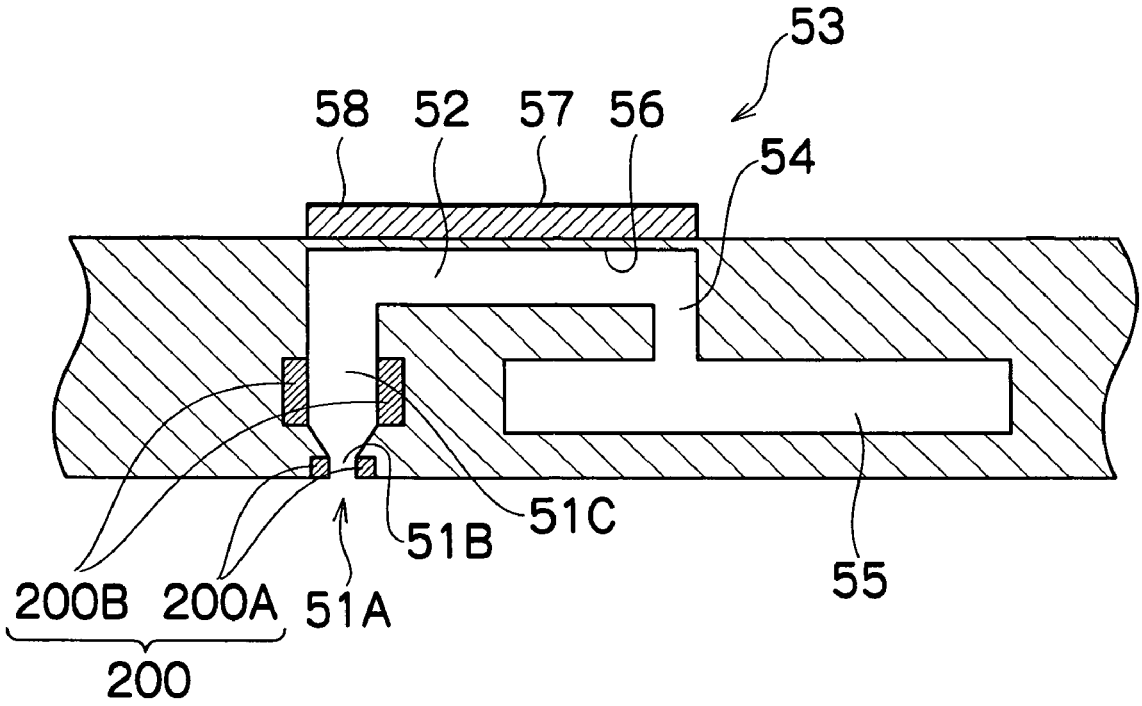
FIG. 11 is a cross-sectional diagram of the ink chamber unit described as a modification of the electrophoretic electrode shown in FIG. 4.
Figure 12:
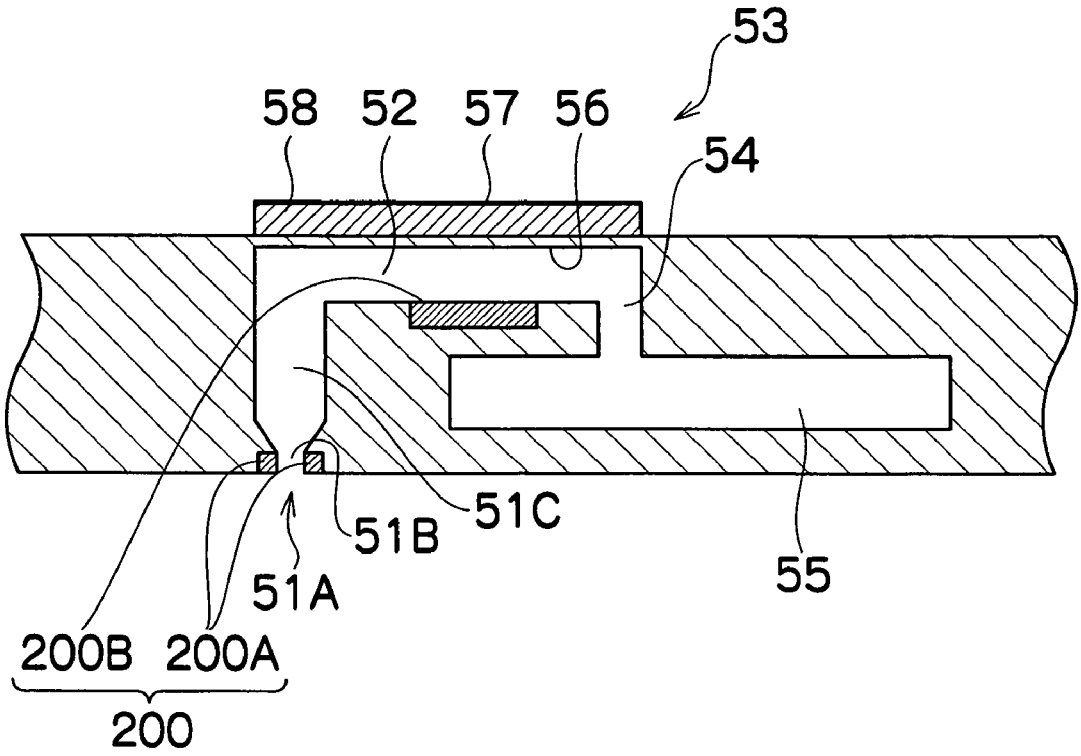
FIG. 12 is a cross-sectional diagram of the ink chamber unit described as another modification of the electrophoretic electrode shown in FIG. 4.

FIGS. 11 and 12 are cross-sectional diagrams of the ink chamber unit 53 that show the positioning of the electrophoretic electrode 200 provided to the present inkjet recording apparatus 10. In FIGS. 11 and 12, like reference characters designate the same or similar parts to those in FIG. 4, and description thereof is omitted.

The electrophoretic electrode 200 is composed of a nozzle end portion electrode 200A provided to the nozzle end portion 51B, and a channel electrode 200B provided to the ejection channel 51C upstream in the ink flow channel from the nozzle end portion electrode 200A (nearer the pressure chamber), which are provided on the external periphery of the duct and on the external periphery of the ejection channel, respectively. Of course, the electrodes may be given a prescribed liquid-repellant treatment and mounted inside the nozzle end portion 51B and the inside of the ejection channel 51C.

The nozzle end portion electrode 200A and the channel electrode 200B each have substantially the same length as the external peripheral length of the duct of the nozzle end portion 51B and the ejection channel 51C, each may be provided to encompass the duct of the nozzle end portion 51B and the ejection channel 51C in the external peripheral direction, and each may have a length shorter than the external peripheral length of the duct of the nozzle end portion 51B and the ejection channel 51C.

Furthermore, a plurality of nozzle end portion electrodes 200A and channel electrodes 200B may be provided along the external peripheral direction of the ducts (separately).

FIG. 12 shows an example of another positioning of the electrophoretic electrode 200 shown in FIG. 11. As shown in FIG. 12, the channel electrode 200B may be provided on the outside of the pressure chamber 52.

Since the print head 50 of the present inkjet recording apparatus 10 has a structure with a layered thin plate member (cavity plate) in which an opening, hole, groove, or the like is formed to provide an ink channel, ink chamber, or the like, one of the electrodes (common side electrode) in the electrophoretic electrode 200 may also serve as the plate from which the nozzle end portion 51B is formed, the plate from which the ejection channel 51C is formed, or the plate from which the pressure chamber 52 (pressure chamber wall) is formed.

Preliminary ejection using the electrophoretic electrode 200 shown in FIGS. 11 and 12 will next be described using FIGS. 13 through 15.

Figure 13:
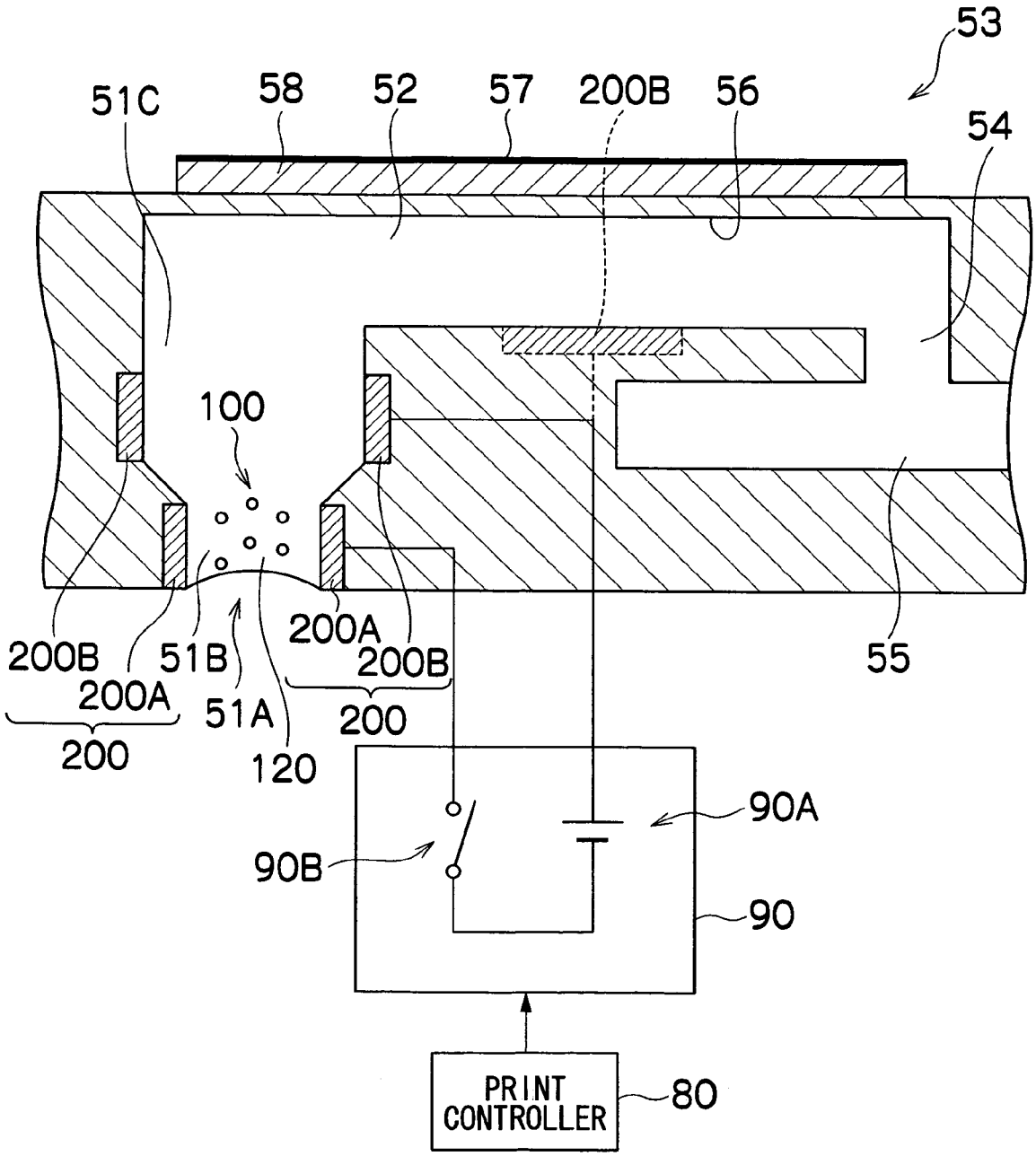
FIG. 13 is a block diagram showing the configuration of the electrophoretic device shown in FIGS. 11 and 12.

As shown in FIG. 13, when a voltage is applied to the electrophoretic electrode 200 from the electrophoretic electrode driver 90 in accordance with the control signal of the print controller 80, an electric field is generated between the nozzle end portion electrode 200A and the channel electrode 200B.

Figure 14:
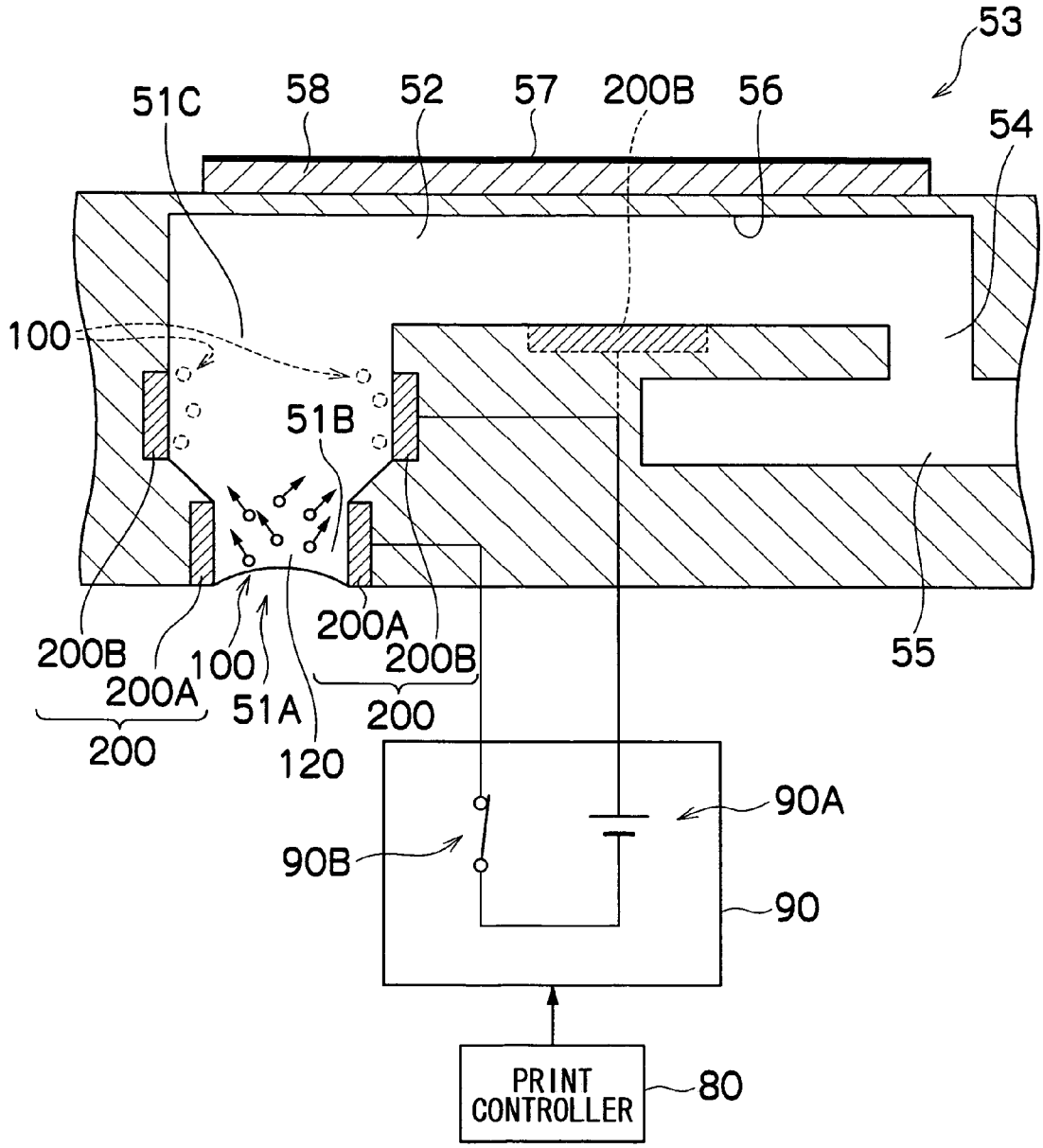
FIG. 14 is a diagram depicting electrophoresis by the electrophoretic device shown in FIGS. 11 and 12.

When a voltage is applied so that the nozzle end portion electrode 200A becomes the minus electrode and the electrophoretic electrode 200B becomes the plus electrode, an electric field oriented in the direction from the nozzle end portion electrode 200A to the channel electrode 200B is generated, and the minus-charged ink color material particles 100 in the electric field move to and are retained in the vicinity of the channel electrode 200B on the plus side as shown in FIG. 14, whereupon the distribution of the ink color material particles 100 in the ink inside the nozzle 51 changes, and the ink 120 in the nozzle opening portion 51A, nozzle end portion 51B, or ejection channel 51C is rendered transparent.

In this state, when the actuator 58 is operated, the ink solvent or ink in a state of low coloration in which the concentration of ink color material particles 100 is reduced (specifically, the cleared ink 120) is ejected from the nozzle 51, and the ink color material particles 100 that are retained in the vicinity of the channel electrode 200B remain inside the nozzle.

Figure 15:
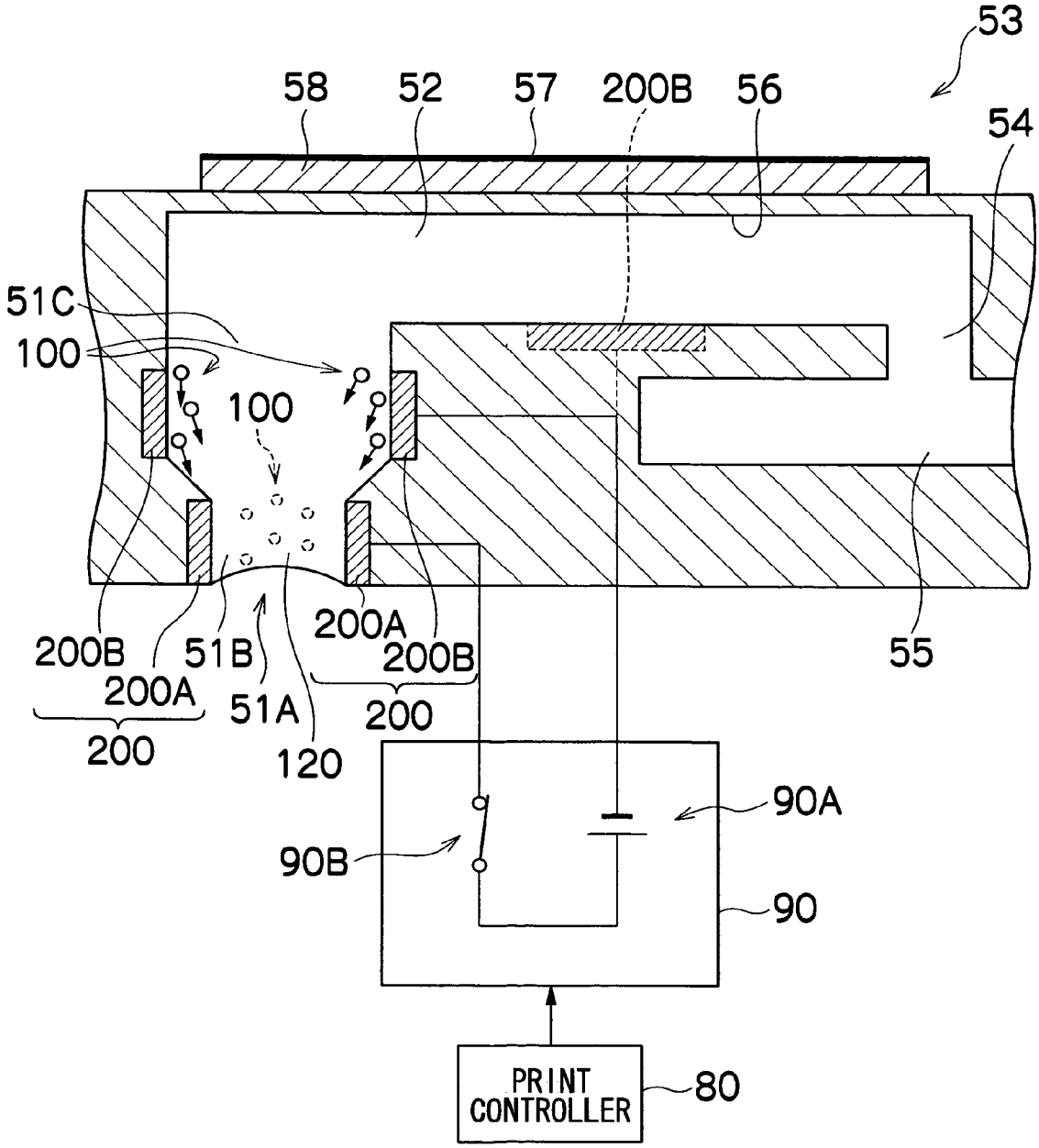
FIG. 15 is a diagram depicting the electrophoresis shown in FIG. 14 and electrophoresis during reverse voltage application.

As shown in FIG. 15, when preliminary ejection is completed, the polarity of the voltage applied to the electrophoretic electrode 200 from the electrophoretic electrode driver 90 is reversed so as to make the nozzle end portion electrode 200A the plus electrode and the channel electrode 200B the minus electrode in order to accelerate dispersion of the ink color material particles 100 into the ink solvent 120 that is newly supplied from the common channel, and the recovery operation by application of a reversed voltage for recovery is performed.

When the polarity of the voltage applied to the electrophoretic electrode 200 is reversed, the ink color material particles 100 retained in the vicinity of the channel electrode 200B move towards the nozzle end portion electrode 200A, and the ink color material particles 100 are dispersed.

After polarity reversal of the applied voltage, the ink color material particles 100 disperses to a certain degree over a prescribed period of time, whereupon control is performed whereby the voltage applied to the electrophoretic electrode 200 from the electrophoretic electrode driver 90 is turned off.

Of course, the ink color material particles 100 may also be given a plus charge, and a voltage may be applied to the electrophoretic electrode 200 whereby the nozzle end portion electrode 200A is the plus electrode and the channel electrode 200B is the minus electrode.

In the modification described above, since the ink color material particles 100 are moved to and retained in the vicinity of the ejection channel 51C or pressure chamber 52 closer to the pressure chamber than the nozzle end portion 51B (specifically, further upstream in the ink flow channel than the nozzle opening portion 51A and the nozzle end portion 51B), further reduction in the amount of ink color material particles 100 consumed during preliminary ejection can be anticipated.

In the present preliminary ejection control, the downtime of each nozzle is computed in the system controller 72 (downtime computation device and selection device) of FIG. 7 based on imaging data (image data) used for printing. A nozzle whose computed downtime is larger than a pre-set threshold value Ta (nozzle having a downtime longer than the threshold value Ta) is selected, and preliminary ejection is performed.

Ejection malfunction is predicted, and preparation for the recovery operation and preliminary ejection for preventing ejection malfunction can be performed.

Figures 16A, 16B:
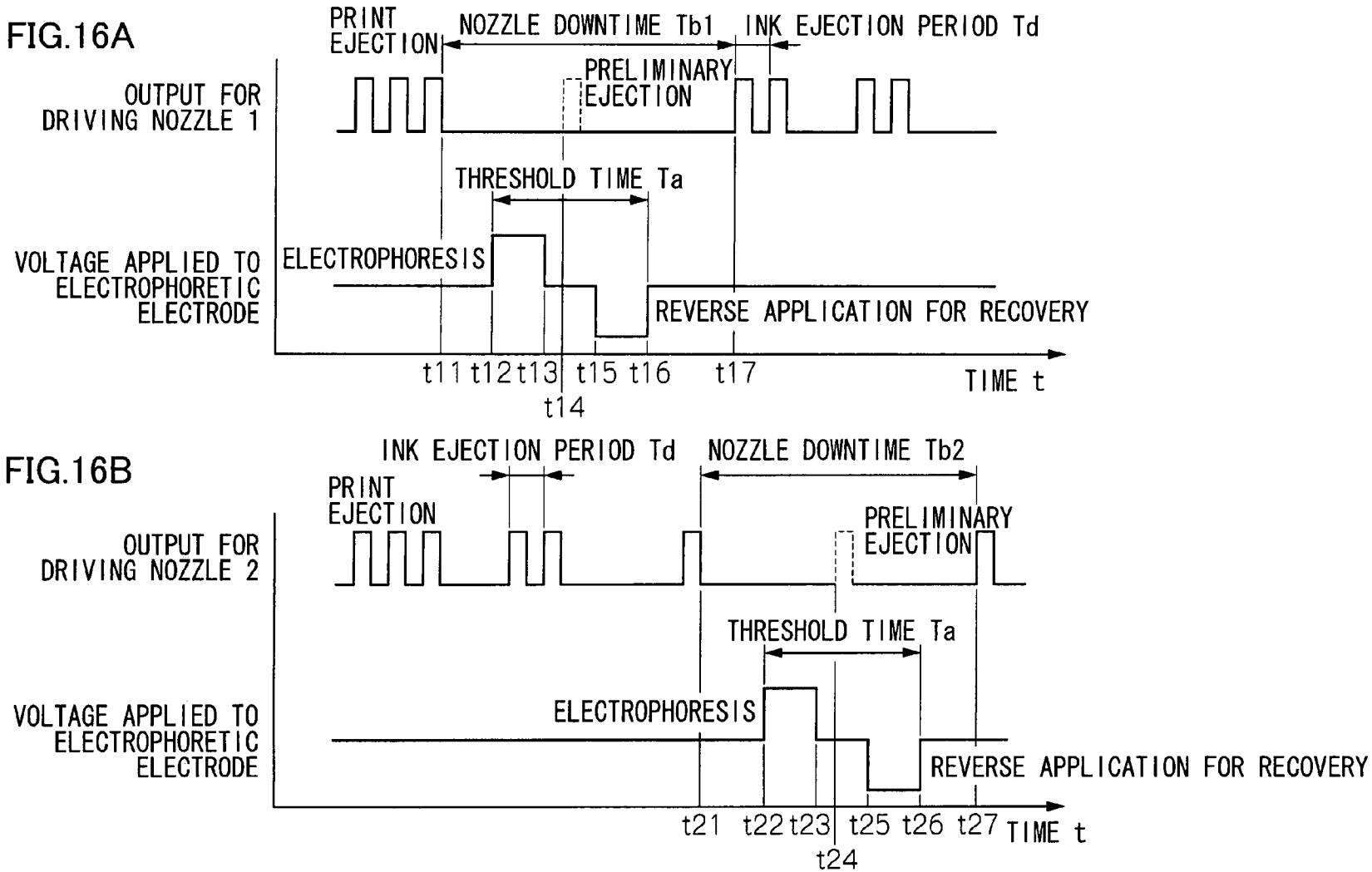
FIGS. 16A and 16B are timing charts showing the flow of preliminary ejection control of the inkjet recording apparatus according to the present embodiment.

FIG. 16A shows the drive output timing and the application timing of the voltage applied to the electrophoretic electrode 59 (200) of an arbitrary nozzle (nozzle 1) provided to the print head 50; and FIG. 16B shows the drive output timing and the application timing of the voltage applied to the electrophoretic electrode 59 (200) of a nozzle (nozzle 2) other than the nozzle 1 shown in FIG. 16A.

FIGS. 16A and 16B show the same output timing of the nozzle 1 and nozzle 2 when printing is performed using the same imaging data.

As shown in FIG. 16A, the system controller 72 of FIG. 7 computes the period in the imaging data in which nozzle 1 is not ejecting (specifically, the period between timing t11 and timing t17) as the downtime Tb1, and preliminary ejection is executed when the downtime Tb1 is longer than the pre-set threshold value Ta (specifically, when Ta<Tb1).

In this preliminary ejection, after ejection for imaging (timing t11), the electrophoretic electrode 59 (200) is turned on (timing t12) in conformity to the timing T14 with which preliminary ejection is performed. When the time needed for the ink color material particles 100 shown in FIG. 8 and other drawings to move to the vicinity of the electrophoretic electrode 59 (200) has elapsed, the voltage applied to the electrophoretic electrode 59 (200) is turned off (timing t13), the actuator 58 shown in FIG. 4 and other drawings is operated, and preliminary ejection is performed (timing t14).

When preliminary ejection is performed, a reverse voltage for recovery is applied to the electrophoretic electrode 59 (200) (timing t15), and the reverse voltage for recovery is turned off after the time needed for the ink color material particles 100 to disperse has passed (timing t16).

As shown in FIG. 16B, the same preliminary ejection control is performed for the nozzle 2.

More specifically, the system controller 72 of FIG. 7 computes the period in the imaging data in which nozzle 2 is not ejecting (specifically, the period between timing t21 and timing t27) as the downtime Tb2, and control is performed whereby preliminary ejection is executed when it is determined that the downtime Tb2 and the pre-set threshold value Ta have the following relation: Ta<Tb2.

After ejection for imaging (timing t21), the electrophoretic electrode 59 (200) is turned on (timing t22) in conformity to the timing t24 with which preliminary ejection is performed, and when the time needed for the ink color material particles 100 shown in FIG. 8 and other drawings to move to the vicinity of the electrophoretic electrode 59 (200) has elapsed, the voltage applied to the electrophoretic electrode 59 (200) is turned off (timing t23), the actuator 58 shown in FIG. 4 and other drawings is operated, and preliminary ejection is performed (timing t24).

When preliminary ejection is performed, a reverse voltage for recovery is applied to the electrophoretic electrode 59 (200) (timing t25), and the reverse voltage for recovery is turned off after the time needed for the ink color material particles 100 to disperse has passed (timing t26).

The time during which the ink color material particles 100 moves through the ink solvent 120 used in this inkjet recording apparatus 10 is approximately 7.5 msec when the migration distance is 30 μm, given a high electrophoretic migration speed of the charged particles of about 4 mm/sec (reference value when a voltage of 1 kV per 1 mm is applied to liquid toner).

Therefore, the electrophoresis period Tc, which is the time needed for a single electrophoresis operation, is from several milliseconds to several tens of milliseconds, and is adequately long compared to the ejection period Td of the ink (since the ejection frequency is this inkjet recording apparatus 10 is 10 kHz to 20 kHz, the ejection period Td is 50 μsec to 100 μsec).

In this preliminary ejection control, the electrophoresis period Tc is set as the threshold value Ta that determines whether preliminary ejection control is performed, and preliminary ejection using electrophoresis is executed when the downtime Tb of the nozzles is longer than the electrophoresis period Tc (specifically, when Tb≧Tc).

In the present embodiment, an example has been described in which only one threshold value Ta for the downtime Tb is provided, but an embodiment is preferred in which a threshold value Ta is provided for each parameter (printing condition) that includes environmental temperature, ink type, media type, and the like, and the threshold values Ta are switched. A configuration may be adopted whereby the threshold values Ta are recorded in a data table, and data for the corresponding parameter are read. The image memory 74 or image buffer memory 82 shown in FIG. 7 may be applied in the recording device which records the data table, and memory contained in the system controller 72, print controller 80, and other components (CPU or MPU) may also be used. Dedicated memory may also be provided.

In switching the threshold value Ta, a configuration may be adopted whereby the operator switches the threshold value Ta using a switching device. An embodiment which performs switching using a switch or the like may be implemented in the switching device, and an embodiment which performs switching by software may also be implemented.

After preliminary ejection (after the voltage applied to the electrophoretic electrode is turned off), a bias sometimes occurs in the distribution of the ink color material particles 100 in the ink inside the nozzle 51 and pressure chamber 52 during the time until the ink color material particles 100 are adequately dispersed, and the ink concentration is changed.

Dots (an image) formed by such ink may sometimes not be of the prescribed concentration, or unevenness in the concentration thereof may occur. Therefore, the dispersion of the ink color material particles 100 in the ink solvent 120 can be accelerated and the ink concentration stabilized by performing control whereby the polarity of the voltage applied to the electrophoretic electrode 59 (200) is periodically switched for a prescribed number of ejections after execution of preliminary ejection, in addition to applying the reverse voltage for recovery. A high-frequency alternating current power supply may also be used instead of switching the polarity of the applied voltage.

Furthermore, to make the prescribed number of ejections after preliminary ejection, the ink concentration is predicted by the system controller (concentration prediction device) 72, and control is performed for varying the ejection quantity by the print controller 80 based on the predicted results. For example, when it is predicted that ink having a lower concentration than normal will be ejected, the ejection quantity is changed so that the actual ejection quantity is greater than the usual ejection quantity. When it is predicted that ink having a higher concentration than normal will be ejected, the ejection quantity is changed so that the actual ejection quantity is smaller than the usual ejection quantity.

The preferred print saturation can thus be maintained by predicting the differential of the ink concentration and shifting the ejection quantity accordingly.

The abovementioned prescribed ejection quantity can be found from the quantity of ink that is affected by electrophoresis.

For example, in the embodiment shown in FIG. 4, when the ink color material particles move inside a nozzle 51 (nozzle end portion 51B) which has a diameter of 30 μm and in which the distance from the nozzle opening portion 51A to the electrophoretic electrode 59 is 30 μm, substantially 20 pL of ink is made transparent by electrophoresis. Change control is performed until 40 pL (=20 pL×2) of ink are ejected, with consideration for the margins and the ejection quantity during preliminary ejection.

In the embodiment shown in FIG. 11, when the diameter of the ejection channel 51C is 100 μm and the distance to the channel electrode 200B (distance between electrophoretic electrodes along the duct) in the ejection channel 51C from the nozzle opening portion 51A (upstream in the ink flow channel) is 200 μm, the ejection quantity is modified in controlled fashion until 1500 pL of ink are ejected, with consideration for the margins and the ejection quantity during preliminary ejection.

Control may be performed so that the abovementioned ink concentration data are converted into a data table for each parameter including the environmental temperature, ink type, and the like, and are recorded in the recording device as shown in FIG. 7 (for example, the image memory 74, the image buffer memory 82, the memory contained in the system controller 72, and the like), and the corresponding data for each parameter are read from the data table.

A concentration determination device which determines the concentration of liquid droplets ejected onto the recording paper 16 may also be provided. Examples of embodiments thereof include an embodiment whereby light is irradiated onto the liquid droplets ejected onto the recording paper 16 and the concentration is determined from the reflected light; an embodiment whereby the ejected liquid droplets are photographed by a CCD or other imaging device, and the concentration thereof is determined from the imaged results; and other embodiments. The concentration determination device may also be used as the print determination unit 24.

In the present embodiment, the drive system of the actuator 58 and the drive system of the electrophoretic electrode 59 (200) are separately provided, but the actuator 58 and the electrophoretic electrode 59 (200) may also configured so as to use the same drive system.

More specifically, the structure of the apparatus can be simplified by performing timing separation control whereby the electrophoretic electrode 59 (200) is actuated using the drive system of the actuator 58 when ejection is not being performed.

In the inkjet recording apparatus 10 configured as described above, since only the ink solvent or ink in a state of low coloration (cleared ink) is ejected after the ink color material in the ink is moved to the vicinity of the electrophoretic electrode 59 by the abovementioned electrophoresis when preliminary ejection is performed, there is less waste of the ink color material particles 100 than when preliminary ejection is performed to eject ink in which ink color material particles 100 are dispersed in the ink solvent 120.

Since preliminary ejection onto the recording paper 16 can be performed even when other nozzles are engaged in printing, maintenance time for preliminary ejection becomes unnecessary, and system throughput can be enhanced.

The timing with which preliminary ejection is performed is selected so that the downtime Tb for each nozzle is computed based on the imaging data, and preliminary ejection is performed when the computed downtime Tb is a time longer than the pre-set threshold value Ta. In other words, nozzles having a downtime Tb that exceeds the threshold value Ta are selected and preliminary ejection is performed based on the nozzle downtimes Tb computed from the imaging data.

When the electrophoresis period is applied to this threshold value Ta, the time for performing preliminary ejection can be ensured even if it takes more time to perform preliminary ejection using electrophoresis than the ejection period.

A print head used in an inkjet recording apparatus has been described as the droplet ejection head in the present embodiment, but the present invention can also be applied to an ejection head used in a liquid ejection apparatus which ejects a liquid (water, chemical liquid, resist, treatment liquid) onto a wafer or glass plate, an epoxy or other substrate, or another printed medium and forms an image, circuit wiring, a machining pattern, or other shape.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ejection head, comprising:

an ejection aperture which ejects onto a receiving medium a liquid in which charged dispersion particles are dispersed in a solvent;

a pressure chamber which contains the liquid;

an ejection channel which connects the ejection aperture with the pressure chamber;

a pressurizing device which applies an ejection pressure to the liquid; and an electrode pair provided facing a vicinity of a meniscus of the liquid inside the ejection channel for generating an electric field inside the ejection channel, wherein at least a portion of the charged dispersion particles are caused to move to a vicinity of at least one of the electrodes in the electrode pair by means of the electric field generated inside the ejection channel, and the liquid from which the at least the portion of the charged dispersion particles have been removed is ejected from the ejection aperture by the pressurizing device.

2. The ejection head as defined in claim 1, wherein a polarity of a voltage applied to the electrode pair is reversed to thereby reverse a direction of the electric field generated inside the ejection channel.

3. The ejection head as defined in claim 1, wherein during a preliminary ejection for ejecting the liquid inside the ejection channel, a voltage is applied to the electrode pair to move the charged dispersion particles to the vicinity of at least one of the electrodes in the electrode pair, and the liquid from which the at least the portion of the charged dispersion particles have been removed is ejected from the ejection aperture.

4. An ejection head, comprising:

an ejection aperture which ejects onto a receiving medium a liquid in which charged dispersion particles are dispersed in a solvent;

a pressure chamber which contains the liquid;

an ejection channel which connects the ejection aperture with the pressure chamber;

a pressurizing device which applies an ejection pressure to the liquid; and an electrode pair including a first electrode and a second electrode, the first electrode being provided in a vicinity of a meniscus of the liquid inside the ejection channel, the second electrode being provided one of in the ejection channel upstream in the liquid channel from the first electrode and in the pressure chamber, the electrode pair generating an electric field in at least one of an area inside of the ejection channel and an area from the ejection channel to the inside of the pressure chamber, wherein at least a portion of the charged dispersion particles are caused to move to a vicinity of at least one of the electrodes in the electrode pair by means of the electric field generated inside the ejection channel, and the liquid from which the at least the portion of the charged dispersion particles have been removed is ejected from the ejection aperture by the pressurizing device.

5. The ejection head as defined in claim 4, wherein a voltage is applied between the electrode pair to generate the electric field so as to move the charged dispersion particles to the vicinity of the second electrode.

6. The ejection head as defined in claim 4, wherein a polarity of a voltage applied to the electrode pair is reversed to thereby reverse a direction of the electric field generated inside the ejection channel.

7. The ejection head as defined in claim 4, wherein during a preliminary ejection for ejecting the liquid inside the ejection channel, a voltage is applied to the electrode pair to move the charged dispersion particles to the vicinity of at least one of the electrodes in the electrode pair, and the liquid from which the at least the portion of the charged dispersion particles have been removed is ejected from the ejection aperture.

8. An image forming apparatus which forms an image on an image formation medium using a liquid in which charged dispersion particles are dispersed in a solvent, the apparatus comprising:

an ejection head including: an ejection aperture which ejects the liquid onto the image formation medium; a pressure chamber which contains the liquid; an ejection channel which connects the ejection aperture with the pressure chamber; a pressurizing device which applies an ejection pressure to the liquid; and an electrode pair provided facing a vicinity of a meniscus of the liquid inside the ejection channel for generating an electric field inside the ejection channel;

a voltage control device which controls a voltage applied to the electrode pair so that the charged dispersion particles are caused to move to a vicinity of at least one of the electrodes in the electrode pair and at least a portion of the charged dispersion particles are removed from the liquid; and an ejection control device which performs control so that the liquid from which the at least the portion of the charged dispersion particles have been removed is ejected from the ejection aperture using the pressurizing device.

9. The image forming apparatus as defined in claim 8, wherein the voltage control device reverses a polarity of the voltage applied to the electrode pair and thereby reverses a direction of the electric field generated inside the ejection channel.

10. The image forming apparatus as defined in claim 8, wherein during a preliminary ejection for ejecting the liquid inside the ejection channel, the voltage control device applies the voltage to the electrode pair to cause the charged dispersion particles to move to the vicinity of at least one of the electrodes in the electrode pair, and the liquid from which the at least the portion of the charged dispersion particles have been removed is ejected from the ejection aperture by the pressurizing device.

11. The image forming apparatus as defined in claim 10, further comprising:

a downtime computation device which computes a downtime of each of ejection apertures in the ejection head from the image data; and a selection device which selects at least one ejection aperture of which downtime computed by the downtime computation device is larger than a pre-set threshold value, wherein the ejection control device performs control such that the preliminary ejection is performed for the at least one ejection aperture selected by the selection device.

12. The image forming apparatus as defined in claim 11, wherein during the preliminary ejection from the at least one ejection aperture selected by the selection device, the liquid from which the at least the portion of the charged dispersion particles have been removed is ejected onto the image formation medium during image formation.

13. The image forming apparatus as defined in claim 10, further comprising:

a concentration prediction device which predicts a concentration of the liquid to be ejected after the preliminary ejection, wherein the ejection control device performs control which changes an ejected quantity of the liquid ejected after the preliminary ejection according to the concentration predicted by the concentration prediction device.

14. The image forming apparatus as defined in claim 10, wherein the voltage control device performs control so as to reverse a polarity of the voltage applied to the electrode pair a plurality of times after the preliminary ejection.

15. An image forming apparatus which forms an image according to image data on an image formation medium using a liquid in which charged dispersion particles are dispersed in a solvent, the apparatus comprising:

an ejection head including: an ejection aperture which ejects the liquid onto the image formation medium; a pressure chamber which contains the liquid; an ejection channel which connects the ejection aperture with the pressure chamber; a pressurizing device which applies an ejection pressure to the liquid; and an electrode pair including a first electrode and a second electrode, the first electrode being provided in a vicinity of a meniscus of the liquid inside the ejection channel, the second electrode being provided one of in the ejection channel upstream in the liquid channel from the first electrode and in the pressure chamber, the electrode pair generating an electric field in at least one of an area inside of the ejection channel and an area from the ejection channel to the inside of the pressure chamber;

a voltage control device which controls a voltage applied to the electrode pair so that the charged dispersion particles are caused to move to a vicinity of at least one of the electrodes in the electrode pair and at least a portion of the charged dispersion particles are removed from the liquid; and an ejection control device which performs control so that the liquid from which the at least the portion of the charged dispersion particles have been removed is ejected from the ejection aperture using the pressurizing device.

16. The image forming apparatus as defined in claim 15, wherein the voltage control device controls the voltage applied to the electrode pair to generate the electric field so as to move the charged dispersion particles to the vicinity of the second electrode.

17. The image forming apparatus as defined in claim 15, wherein the voltage control device reverses a polarity of the voltage applied to the electrode pair and thereby reverses a direction of the electric field generated inside the ejection channel.

18. The image forming apparatus as defined in claim 15, wherein during a preliminary ejection for ejecting the liquid inside the ejection channel, the voltage control device applies the voltage to the electrode pair to cause the charged dispersion particles to move to the vicinity of at least one of the electrodes in the electrode pair, and the liquid from which the at least the portion of the charged dispersion particles have been removed is ejected from the ejection aperture by the pressurizing device.

19. The image forming apparatus as defined in claim 18, further comprising:

a downtime computation device which computes a downtime of each of ejection apertures in the ejection head from the image data; and a selection device which selects at least one ejection aperture of which downtime computed by the downtime computation device is larger than a pre-set threshold value, wherein the ejection control device performs control such that the preliminary ejection is performed for the at least one ejection aperture selected by the selection device.

20. The image forming apparatus as defined in claim 19, wherein during the preliminary ejection from the at least one ejection aperture selected by the selection device, the liquid from which the at least the portion of the charged dispersion particles have been removed is ejected onto the image formation medium during image formation.

21. The image forming apparatus as defined in claim 18, further comprising:

a concentration prediction device which predicts a concentration of the liquid to be ejected after the preliminary ejection, wherein the ejection control device performs control which changes an ejected quantity of the liquid ejected after the preliminary ejection according to the concentration predicted by the concentration prediction device.

22. The image forming apparatus as defined in claim 18, wherein the voltage control device performs control so as to reverse a polarity of the voltage applied to the electrode pair a plurality of times after the preliminary ejection.

23. An ejection control method for an ejection apparatus provided with an ejection head including an ejection aperture which ejects onto a receiving medium a liquid in which charged dispersion particles are dispersed in a solvent, the method comprising the steps of:

applying a voltage between an electrode pair disposed facing a vicinity of a meniscus of the liquid inside an ejection channel which connects the ejection aperture with a pressure chamber which contains the liquid so as to generate an electric field inside the ejection channel;

controlling the voltage applied to the electrode pair so as to cause the charged dispersion particles to move to a vicinity of at least one of the electrodes in the electrode pair, and thereby removing at least a portion of the charged dispersion particles from at least a portion of the liquid inside the ejection channel; and ejecting from the ejection aperture the liquid from which the at least the portion of the charged dispersion particles have been removed.

* * * * *